US008709690B2

(12) United States Patent
Nakamura et al.

(10) Patent No.: US 8,709,690 B2
(45) Date of Patent: Apr. 29, 2014

(54) ELECTROPHOTOGRAPHIC PHOTORECEPTOR AND IMAGE FORMING APPARATUS INCLUDING THE SAME

(75) Inventors: Tomomi Nakamura, Osaka (JP); Satoshi Katayama, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 344 days.

(21) Appl. No.: 12/841,397

(22) Filed: Jul. 22, 2010

(65) Prior Publication Data

US 2011/0020739 A1 Jan. 27, 2011

(30) Foreign Application Priority Data

Jul. 27, 2009 (JP) ..... 2009-174309

(51) Int. Cl.
*G03G 15/00* (2006.01)

(52) U.S. Cl.
USPC ..... 430/60; 430/56; 430/96

(58) Field of Classification Search
CPC ..... G03G 5/0696; G03G 5/0507; G03G 5/14704; G03G 5/144; G03G 5/142
USPC ..... 430/56–96
See application file for complete search history.

(56) References Cited

U.S. PATENT DOCUMENTS

| | | | | |
|---|---|---|---|---|
| 4,518,669 | A | 5/1985 | Yashiki | |
| 4,981,767 | A | 1/1991 | Tokura et al. | |
| 5,213,929 | A | 5/1993 | Takano et al. | |
| 5,298,353 | A | 3/1994 | Ohmori | |
| 5,529,869 | A * | 6/1996 | Nguyen | 430/78 |
| 5,972,551 | A | 10/1999 | Miyauchi | |
| 2004/0202947 | A1 * | 10/2004 | Wu et al. | 430/59.4 |
| 2006/0088778 | A1 * | 4/2006 | Itami et al. | 430/60 |
| 2006/0127782 | A1 * | 6/2006 | Ishida et al. | 430/60 |

(Continued)

FOREIGN PATENT DOCUMENTS

| | | |
|---|---|---|
| JP | 48-47344 | 7/1973 |
| JP | 56-52757 | 5/1981 |

(Continued)

OTHER PUBLICATIONS

Nitta et al., "New Method of Joining a Polygon Mirror Using a Shrink Fitter", *Japan Hardcopy '96*, 1996, pp. 117-120 (English Translation—partial).

*Primary Examiner* — Mark F Huff
*Assistant Examiner* — Rashid Alam
(74) *Attorney, Agent, or Firm* — Nixon & Vanderhye P.C.

(57) ABSTRACT

A photoreceptor comprising an undercoat layer between a conductive support and a photosensitive layer, wherein the undercoat layer contains at least metal oxide microparticles coated with anhydrous silicon dioxide and a first binder resin, the photosensitive layer is a monolayered photosensitive layer containing at least a charge generation material and a charge transport material or a multilayered photosensitive layer formed of a charge generation layer containing a charge generation material and a charge transport layer containing a charge transport material stacked in this order or in an inverse order, and the charge generation material contains a crystal type oxotitanylphthalocyanine having peaks in an X-ray diffraction spectrum with Cu—Kα characteristic X-rays (0.15418 nm) at Bragg angles (2θ±0.2°) of 7.3°, 9.4°, 9.6°, 11.6°, 13.3°, 17.9°, 24.1° and 27.2°, in which a peak bundle formed by overlapping the peaks at 9.4° and 9.6° is a largest peak, and the peak at 27.2° is a second largest peak; and an X-type metal-free phthalocyanine having peaks in the X-ray diffraction spectrum at Bragg angles (2θ±0.2°) of 7.5°, 9.1°, 16.7°, 17.3° and 22.3°.

10 Claims, 2 Drawing Sheets

(56) References Cited

U.S. PATENT DOCUMENTS

| | | | | |
|---|---|---|---|---|
| 2007/0298259 | A1* | 12/2007 | Matsumoto | 428/407 |
| 2008/0305426 | A1* | 12/2008 | Kurimoto et al. | 430/125.5 |
| 2009/0068577 | A1* | 3/2009 | Ohta et al. | 430/58.15 |
| 2009/0245868 | A1* | 10/2009 | Fukushima et al. | 399/159 |

FOREIGN PATENT DOCUMENTS

| | | |
|---|---|---|
| JP | 59-93453 | 5/1984 |
| JP | 4-172362 | 6/1992 |
| JP | 4-229872 | 8/1992 |
| JP | 5-134437 | 5/1993 |
| JP | 6-39575 | 5/1994 |
| JP | 7-91486 | 10/1995 |
| JP | 2754739 | 3/1998 |
| JP | 2780295 | 5/1998 |
| JP | 10-237347 | 9/1998 |
| JP | 3005052 | 11/1999 |
| JP | 2000-242016 | 9/2000 |
| JP | 2002-131952 | 5/2002 |
| JP | 2002-131954 | 5/2002 |
| JP | 2008-299020 A | 12/2008 |

* cited by examiner

ELECTROPHOTOGRAPHIC PHOTORECEPTOR AND IMAGE FORMING APPARATUS INCLUDING THE SAME

CROSS-REFERENCE TO RELATED APPLICATIONS

This application is related to Japanese Patent Application No. 2009-174309 filed on Jul. 27, 2009 whose priority is claimed under 35 USC §119, the disclosure of which is incorporated by reference in its entirety.

BACKGROUND OF THE INVENTION

1. Field of the Invention

The present invention relates to an electrophotographic photoreceptor to be used in an electrophotographic system image forming apparatus, in particular, an image forming apparatus having a high resolution of 1200 dpi, and a high-resolution image forming apparatus including the electrophotographic photoreceptor.

2. Description of the Related Art

Electrophotographic system image forming apparatuses (also referred to as "electrophotographic devices") that form images using electrophotographic technologies are used as copying machines, printers, facsimile machines and the like to a great extent.

Electrophotographic photoreceptors (hereinafter, also referred to as "photoreceptor") that are used in electrophotographic processes have a structure including a photosensitive layer containing a photoconductive material stacked on a conductive support.

Photoreceptors including a photosensitive layer containing an inorganic photoconductive material as a main component (also referred to as "inorganic photoreceptors") have been used widely, but they have a shortcoming in any of heat resistance, storage stability, toxicity to the human body and environment, sensitivity, durability, occurrence of image defects, productivity, production costs and the like. That is, no conventional inorganic photoreceptors have been satisfactory in every way.

On the other hand, research and development have been promoted for photoreceptors including a photosensitive layer containing an organic photoconductive material as a main component (also referred to as "organic photoreceptors") and the organic photoreceptors have been becoming the mainstream of photoreceptors nowadays.

The organic photoreceptors have some problems in sensitivity, durability and environmental stability. However, they have more advantages compared with the inorganic photoreceptors in terms of toxicity, production costs, degree of freedom of material design and the like. In the organic photoreceptors, for example, their photosensitive layers can be formed by an easy and inexpensive method represented by a dip coating method.

For the organic photoreceptors, there have been proposed: a structure in which a monolayered photosensitive layer obtained by dispersing a charge generation material and a charge transport material (also referred to as "charge transfer material") in a binder resin (also referred to as "binding resin" or "binding agent resin") is stacked on a conductive support; and a structure in which a multilayered photosensitive layer composed of a charge generation layer obtained by dispersing a charge generation material in a binder resin and a charge transport layer obtained by dispersing a charge transport material in a binder resin formed in this order or a reversely multilayered photosensitive layer composed of such a charge generation layer and such a charge transport layer formed in a reverse order is stacked on a conductive support. Out of these photoreceptors, function separation type photoreceptors having a multilayered photosensitive layer and a reversely multilayered photosensitive layer have been widely in a practical use, because they are excellent in electrophotographic characteristics and durability, and allow design variation for characteristics of the photoreceptors as having a higher degree of freedom of material selection.

In recent years, as digitization of image information has been promoted, semiconductor lasers and LED arrays have been used instead of conventional white lights as a recording light source (also referred to as "photosensitizing light source") for exposing a photosensitive layer of a photoreceptor. Currently, as the recording light source, near-infrared laser light sources having a wavelength of 780 nm and red light sources having a wavelength of 650 nm are frequently used.

When digitized image information such as characters is directly used as computer output, the image information is recorded on a photoreceptor according to the computer output information that is converted into a light signal. When image information of a document is input, on the other hand, the image information of the document is read as a light signal, the light signal is converted into a digital electrical signal, and then the digital electrical signal is converted into a light signal again to record the image information on a photoreceptor according to the light signal.

In either case, a part of the photosensitive layer irradiated with a fine spot of light applied from an optical recording head, a recording optical system or the like is developed with a toner to record the image information on the photosensitive layer.

An image is expressed by a group or an array of fine dots developed with a toner. Such dots are called pixels. The optical recording head, the recording optical system and the like have therefore been developed so, as to give higher resolution in order to form a spot that is as fine as possible to allow image information to be recorded with a higher density.

Regarding the optical system for recording image information on a photosensitive layer, there have been developed a variable spot laser recording system, a multi-laser beam recording system and an ultraprecise and ultrahigh-speed polygon mirror (see, for example, p. 117-120 of "New Method of Joining a Polygon Mirror Using a Shrink Fitter" written by Isami NITTA, Kimio KOMATA, Daisuke KONNO, collected papers of Japan Hardcopy '96, 1996. As a result, an optical system for recording image information on a photosensitive layer with a recording density of 1200 dpi or more (dots per inch) has been developed presently.

Even with the development of such an optical system for recording image information on a photosensitive layer with a higher density, it is not necessarily easy to record image information on a photosensitive layer as an electrostatic latent image with good reproducibility. This is attributed to the fact that the light intensity distribution of laser beams is a Gaussian distribution, having a peak in a central part and a spread in an outer part. That is, it was difficult to aim at higher image quality in conventional high-sensitive photoreceptors, because they are exposed also to light having a spread in an outer part to be developed to cause spread of dots.

As high-sensitive photoreceptors, for example, the specifications of Japanese Patent No. 1950255 and Japanese Patent No. 2128593 propose a photoreceptor using a Y-type crystal oxotitanylphthalocyanine as a charge generation material, and Japanese Unexamined Patent Publication No. HEI 10(1998)-237347 proposes a photoreceptor using a novel crystal type oxotitanylphthalocyanine as a charge generation material.

In addition, as photoreceptors using two or more kinds of phthalocyanines as a charge generation material for the purpose of attaining higher sensitivity around 780 nm, which is an emission wavelength of semiconductor lasers, for example, Japanese Patent No. 2780295 proposes a photoreceptor using a mixed crystal of an oxotitanylphthalocyanine and a metal-free phthalocyanine, and Japanese Patent No. 2754739 proposes a photoreceptor using a composition of an oxotitanylphthalocyanine and a metal-free phthalocyanine.

However, these high-sensitive photoreceptors have high sensitivity to weak exposure, too. Accordingly, they cannot achieve higher resolution for the above-described reason.

Further, as photoreceptors using a mixture of two kinds of phthalocyanines as a charge generation material for the purpose of attaining higher resolution, for example, Japanese Unexamined Patent Publication No. HEI 5(1993)-134437 proposes a mixture of two kinds of specific crystal type oxotitanylphthalocyanines, and Japanese Patent No. 3005052 and Japanese Unexamined Patent Publication No. 2002-131954 propose a mixture of a specific crystal type oxotitanylphthalocyanine and a metal-free phthalocyanine. Such photoreceptors are less prone to light decay by weak exposure and high-sensitive to strong exposure to fall into complete potential decay. That is, they have high sensitivity, responding linearly to exposure energy.

While approach to higher-quality images has been developed from a view point of photoreceptors as described above, image forming apparatuses such as copying machines, printers and the like need to provide stable output of beautiful images under various environments, and photoreceptors to be mounted in such image forming apparatuses are required to have appropriate stability, accordingly.

In the meantime, there is a problem in the attempt to attain higher-quality images: fine black dots are generated in an unexposed region.

The fine black dots are an image defect that are generated in a photoreceptor in which a photosensitive layer is directly stacked on a conductive support, because in such a photoreceptor, carrier injection is likely to occur from a side of the conductive support, and surface charges of the photoreceptor, when charged, disappear or decrease microscopically even in a dark place.

In a high-sensitive photoreceptor, in addition, its charge generation material itself has high sensitivity to easily generate carriers even in a dark place due to thermal excitation, also leading to generation of the fine black dots. The image defect of such fine black dots is more significant under an environment of higher temperature and higher humidity.

To prevent the image defect of such fine black dots, to cover defects on the surface of the conductive support, to improve chargeability, to enhance adhesion of the photosensitive layer, and to improve coatability, an undercoat layer is disposed between the conductive support and the photosensitive layer.

Conventionally, various resin materials and resin materials containing, for example, inorganic compound particles such as titanium oxide powders have been considered as the undercoat layer.

Known examples of the resin materials include polyethylene resins, polypropylene resins, polystyrene resins, acrylic resins, vinyl chloride resins, vinyl acetate resins, polyurethane resins, epoxy resins, polyester resins, melamine resins, silicon resins, polyvinyl butyral resins, polyamide resins; copolymer resins including two or more types of these repeat units; polyvinyl alcohol and ethylcellulose.

Out of these resin materials, it is disclosed that the polyamide resins are particularly preferable (see, for example, Japanese Unexamined Patent Publication No. SHO 48(1973)-47344).

In a photoreceptor having a monolayered undercoat layer of a resin such as a polyamide resin, however, residual potential accumulates greatly to reduce sensitivity and cause image fogging, while generation of the fine black dots is inhibited. Such tendency is particularly significant under a low-humidity environment.

Therefore, in order to prevent generation of image defects attributed to the conductive support and improve a variation of the residual potential according to environmental fluctuation, Japanese Unexamined Patent Publication No. SHO 56(1981)-52757 proposes to contain surface-untreated titanium oxide powders in the undercoat layer, Japanese Unexamined Patent Publication No. SHO 59(1984)-93453 proposes to contain titanium oxide microparticles coated with alumina or the like in the undercoat layer to improve dispersibility of titanium oxide powders, Japanese Unexamined Patent Publication No. HEI 4(1992)-172362 proposes to contain metal oxide particles surface-treated with a titanate coupling agent in the undercoat layer, and Japanese Unexamined Patent Publication No. HEI 4(1992)-229872 proposes to contain metal oxide particles surface-treated with a silane compound in the undercoat layer.

As described above, many photoreceptors enabled for high resolution and many photoreceptors aiming at improvement in environmental stability have been proposed. However, they are still insufficient for stable maintenance of high resolution under various environments.

Examples of a means for attaining higher resolution include a method in which a low-sensitive photoreceptor is used so that the sensitivity to light in a region around a region to be exposed is lower and the photoreceptor is exposed only to strong light in the center to form dots precisely. However, this method is compatible with low-speed printers, but incompatible with recent high-speed printers. That is, the problem is that the photoreceptor is low-sensitive to need a high-power semiconductor laser, have high residual potential, and significantly rise in residual potential when used repeatedly, leading to low image density.

In addition, there is another problem: in a high-sensitive photoreceptor using a phthalocyanine as a charge generation material, the high sensitivity leads to more carrier generation due to thermal excitation to cause generation of fine black dots in the unexposed region, which is significant under a high-temperature and high-humidity environment. This problem can be avoided to some extent by providing an undercoat layer, but it is not sufficient because the problem has become relatively significant and noticeable as the resolution is improved, though it was not so serious in conventional low-resolution machines. In addition, depending on the kind of the undercoat layer, introduction of an undercoat layer may lead to reduction in the sensitivity under a low-humidity environment.

Thus, as the resolution of image forming apparatuses is improved, things that were not considered a problem before can now cause a defect, which cannot be handled by prior art technologies.

SUMMARY OF THE INVENTION

Thus, the present invention provides a photoreceptor comprising an undercoat layer between a conductive support and a photosensitive layer, wherein the undercoat layer contains at least metal oxide microparticles coated with anhydrous silicon dioxide and a first binder resin, the photosensitive layer is a monolayered photosensitive layer containing at least a charge generation material and a charge transport material or a multilayered photosensitive layer formed of a charge generation layer containing a charge generation material and a charge transport layer containing a charge transport material stacked in this order or in an inverse order, and the charge generation material contains a crystal type oxotitanylphthalocyanine having peaks in an X-ray diffraction spectrum with CuKα characteristic X-rays (0.15418 nm) at Bragg angles (2θ±0.2°) of 7.3°, 9.4°, 9.6°, 11.6°, 13.3°, 17.9°, 24.1° and 27.2°, in which a peak bundle formed by overlapping the peaks at 9.4° and 9.6° is a largest peak, and the peak at 27.2° is a second largest peak; and an X-type metal-free phthalocyanine having peaks in the X-ray diffraction spectrum at Bragg angles (2θ±0.2°) of 7.5°, 9.1°, 16.7°, 17.3° and 22.3°.

The present invention also provides an image forming apparatus comprising at least: the photoreceptor as described above; a charging means for charging the photoreceptor; an exposure means for exposing the charged photoreceptor to form an electrostatic latent image; a developing means for developing the electrostatic latent image formed by the exposure to form a toner image; a transfer means for transferring the toner image formed by the development onto a recording material; a fixing means for fixing the transferred toner image onto the recording material to form an image; and a cleaning means for removing and recovering a toner left on the photoreceptor, Wherein the exposure means is an exposure device exposing a surface of the photoreceptor by using a semiconductor laser with a pixel density of 1200 dpi or more to form the electrostatic latent image.

DESCRIPTION OF THE PREFERRED EMBODIMENTS

Figure 1:
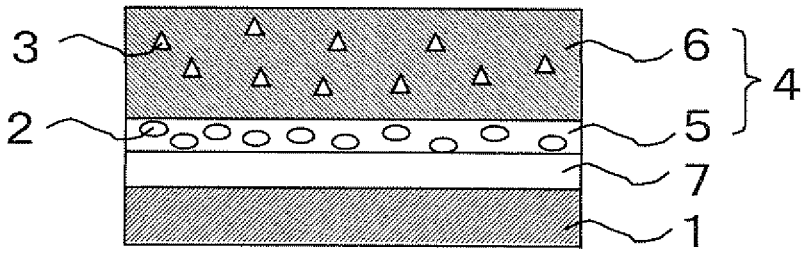
FIG. 1 is a schematic sectional view illustrating a structure of an essential part of a photoreceptor (multilayered photoreceptor) of the present invention.

It is an object of the present invention, therefore, to provide a photoreceptor that is free from generation of fine black dots and fogging under a high-temperature and high-humidity environment, that does not deteriorate in sensitivity under a low-temperature and low-humidity environment, that has high stability to environmental fluctuation, and that is applicable to a high-resolution machine, and an image forming apparatus including the photoreceptor.

The inventors of the present invention have made intensive studies to solve the above-described problems and, as a result, found that the above-described problems can be solved by including metal oxide microparticles that have gone through a specific surface treatment and a binder resin in an undercoat layer, and including a crystal type phthalocyanine having a specific X-ray diffraction pattern and an X-type metal-free phthalocyanine as a charge generation material in a photosensitive layer, to reach completion of the present invention.

The photoreceptor of the present invention comprises an undercoat layer between a conductive support and a photosensitive layer, wherein the undercoat layer contains at least metal oxide microparticles coated with anhydrous silicon dioxide and a first binder resin, the photosensitive layer is a monolayered photosensitive layer containing at least a charge generation material and a charge transport material or a multilayered photosensitive layer formed of a charge generation layer containing a charge generation material and a charge transport layer containing a charge transport material stacked in this order or in an inverse order, and the charge generation material contains a crystal type oxotitanylphthalocyanine having peaks in an X-ray diffraction spectrum with CuKα characteristic X-rays (0.15418 nm) at Bragg angles (2θ±0.2°) of 7.3°, 9.4°, 9.6°, 11.6°, 13.3°, 17.9°, 24.1° and 27.2°, in which a peak bundle formed by overlapping the peaks at 9.4° and 9.6° is a largest peak, and the peak at 27.2° is a second largest peak; and an X-type metal-free phthalocyanine having peaks in the X-ray diffraction spectrum at Bragg angles (2θ±0.2°) of 7.5°, 9.1°, 16.7°, 17.3° and 22.3°.

The present invention can provide a photoreceptor that is free from generation of fine black dots and fogging under a high-temperature and high-humidity environment, that does not deteriorate in sensitivity under a low-temperature and low-humidity environment, that has high stability to environmental fluctuation, and that is applicable to a high-resolution machine, and an image forming apparatus including the photoreceptor.

When the X-type metal-free phthalocyanine is contained in the photosensitive layer in a proportion of 10% by weight to 70% by weight with respect to the crystal type oxotitanylphthalocyanine, optimal sensitivity can be achieved and the above-described effects can be obtained more advantageously. When the photoreceptor is exposed with a semiconductor laser whose light intensity distribution is a Gaussian distribution, the photoreceptor is subjected to exposure/potential decay only by strong light in a central part but is not subjected to potential decay by weak light in an outer part, and therefore higher resolution can be attained.

When the metal oxide microparticles are coated with anhydrous silicon dioxide in a proportion of 0.1% by weight to 50% by weight, the above-described effects can be obtained more advantageously. In this case, in addition, influences of humidity fluctuation can be lessened while maintaining electrical characteristics of the metal oxide microparticles, in particular, titanium oxide microparticles.

When titanium oxide microparticles are used as the metal oxide microparticles and a polyamide resin is used as the first binder resin, the above-described effects can be obtained more advantageously. In this case, in addition, dispersibility improves in preparation of a coating solution for undercoat layer formation to inhibit generation of aggregates, allowing formation of a flat coating film. As a result, the resistance can be kept uniform to effectively inhibit generation of fine black dots. Furthermore, since the polyamide resin is easy to mix with the metal oxide microparticles and excellent in adhesion to the conductive support, flexibility of the film can be maintained.

When the metal oxide microparticles and the first binder resin are contained in the undercoat layer in a ratio by weight of 10:90 to 95:5, the metal oxide microparticles produce the above-described effects more advantageously.

When the film thickness of the undercoat layer is 0.05 μm to 5 μm, the above-described effects can be obtained more advantageously. In this case, in addition, sensitivity does not deteriorate under a low-temperature and low-humidity environment, and generation of fine black dots can be inhibited effectively at high temperature.

When the photosensitive layer is a multilayered photosensitive layer, the above-described effects can be obtained more advantageously. In this case, in addition, most suitable materials can be selected for each layer to produce the photoreceptor with no need to consider compatibility among the constituent materials.

The photoreceptor of the present invention will be described in detail with reference to the drawings, on the premise that the present invention is not limited to the following embodiments.

FIG. 1 is a schematic sectional view illustrating a structure of an essential part of a multilayered photoreceptor provided with a multilayered photosensitive layer (also referred to as "function separation type photosensitive layer") formed by stacking a charge generation layer and a charge transport layer in this order.

Specifically, in the photoreceptor of FIG. 1, an undercoat layer 7 and a photosensitive layer (multilayered photosensitive layer) 4 in which a charge generation layer 5 containing a charge generation material 2 and a charge transport layer 6 containing a charge transport material 3 are stacked in this order are formed in this order on a surface of a conductive support 1.

In the present invention, when the photosensitive layer is a multilayered photosensitive layer, the effects of the present invention can be obtained more advantageously, and most suitable materials can be selected for each layer to produce the photoreceptor with no need to consider compatibility among the constituent materials.

The multilayered photosensitive layer of FIG. 1 may be a reversely multilayered photosensitive layer in which the charge generation layer and the charge transport layer are stacked in an inverse order, but the embodiment of FIG. 1 is preferable.

Figure 2:
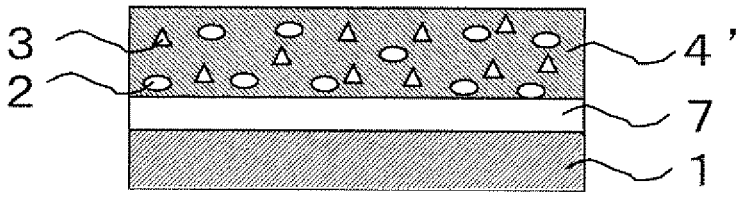
FIG. 2 is a schematic sectional view illustrating a structure of an essential part of a photoreceptor (monolayered photoreceptor) of the present invention.

FIG. 2 is a schematic sectional view illustrating a structure of an essential part of a monolayered photoreceptor provided with a monolayered photosensitive layer formed of a single layer.

Specifically, in the photoreceptor of FIG. 2, the undercoat layer 7 and a photosensitive layer (monolayered photosensitive layer) 4' containing the charge generation material 2 and the charge transport material 3 are formed in this order on the surface of the conductive support 1.

Hereinafter, each component of the present invention will be described in detail.

[Conductive Support 1]

The conductive support functions as an electrode of the photoreceptor and also as a support member for each layer.

The constituent material for the conductive support is not particularly limited as long as it is used in the relevant art.

Specific examples of the constituent material include metal and alloy materials such as aluminum, aluminum alloys, copper, brass, zinc, nickel, stainless steel, chromium, molybdenum, vanadium, indium, titanium, gold and platinum; and materials obtained by laying a metal foil, depositing a metal material or an alloy material, or depositing or applying a layer of a conductive compound such as a conductive polymer, tin oxide, indium oxide and carbon black on a surface of a substrate made of hard paper, glass or a polymer material such as polyethylene terephthalate, polyamide, polyester, polyoxymethylene, polystyrene, cellulose and polylactic acid.

The shape of the conductive support is not limited to a sheet form and a cylindrical form to be mentioned later in the layer structure illustrated in FIGS. 1 and 2, and may be a columnar form, an endless belt (seamless belt) form, or the like.

When each layer is formed on the conductive substrate by a dip coating method as in the case of an embodiment to be described later, the conductive support preferably has a cylindrical form.

As needed, the surface of the conductive support may be processed by anodic oxidation coating treatment, surface treatment using chemicals or hot water, coloring treatment or irregular reflection treatment such as surface roughing to the extent that the image quality is not adversely affected.

The irregular reflection treatment is particularly effective when the photoreceptor of the present invention is used in an electrophotographic process using a laser as an exposure light source. That is, since the wavelengths of laser light are uniform in the electrophotographic process using a laser as the exposure light source, the laser light reflected on the surface of the photoreceptor may interfere with the laser light reflected inside of the photoreceptor, resulting in appearance of interference fringes on an image and generation of an image defect. In this respect, the image defect that may be caused by the interference of laser light with uniform wavelengths can be prevented by giving the irregular reflection treatment to the surface of the conductive support.

[Undercoat Layer (Also Referred to as "Intermediate Layer") 7]

The undercoat layer has a function of preventing charges from being injected into the monolayered photosensitive layer or the multilayered photosensitive layer from the conductive support. In other words, deterioration in the chargeability of the monolayered photosensitive layer or the multilayered photosensitive layer is limited and therefore, a reduction in surface charges on a part other than the parts to be eliminated by the exposure to light is limited, thereby preventing the occurrence of image defects such as fogging. In particular, it is possible to prevent fogging of images called black dots, that is, fine black dots of toner formed on a white background in image formation by a reverse developing process.

The undercoat layer that coats the surface of the conductive support can reduce the degree of irregularities, which is a defect of the surface of the conductive support to uniform the surface, enhance the film-forming characteristic of the monolayered photosensitive layer or the multilayered photosensitive layer, and improve the sticking characteristics (adhesion) between the conductive support and the monolayered photosensitive layer or the multilayered photosensitive layer.

The undercoat layer of the present invention contains at least metal oxide microparticles coated with anhydrous silicon dioxide and a binder resin (first binder resin).

The "particles coated with a specific material", as used herein, means "particles surface-treated with a specific material".

Examples of the metal oxide microparticles include titanium oxide, zinc oxide, aluminum oxide, aluminum hydroxide and tin oxide microparticles. Out of these, in terms of conductivity and dispersibility, titanium oxide and zinc oxide microparticles are preferable, and titanium oxide microparticles are particularly preferable. That is, use of the titanium oxide microparticles as the metal oxide microparticles produces the effects of the present invention more advantageously and improves dispersibility in preparation of the coating solution for undercoat layer formation to inhibit generation of aggregates, allowing formation of a flat coating film. As a result, the resistance can be kept uniform to effectively inhibit generation of fine black dots.

Examples of the crystal type of the titanium oxide include an anatase type, a rutile type, amorphous and the like, and the crystal type of the titanium oxide microparticles of the present invention may be any of the above-mentioned types or may be a mixture of two or more of these types.

In addition, the shape of the metal oxide microparticles of the present invention may be dendritic, acicular or particulate, and is particularly preferably acicular, which allows achievement of a good balance between the film strength and the electrical characteristics.

The "acicular" shape, as used herein, may be a long and narrow form including a bar-like form, a columnar form and a spindle-like form; it does not need to be extremely long and narrow or sharp at an end.

The metal oxide microparticles preferably have an average primary particle diameter of 20 nm to 100 nm.

When the average primary particle diameter of the metal oxide microparticles is less than 20 nm, the dispersion efficiency of the metal oxide microparticles may decrease to cause aggregation, making generation of fine black dots in images more likely. It also leads to increase in liquid viscosity, which is not preferable in terms of storage stability. It is not preferable that the average primary particle diameter of the metal oxide microparticles is more than 100 nm, because in this case, chargeability in a micro area decreases in the formation of the undercoat layer, leading to generation of fine black dots.

Here, the average primary particle diameter of the metal oxide microparticles is determined by measuring and averaging 50 or more particles for the diameter based on an SEM (S-4100, product by Hitachi High-Technologies Corporation) photograph.

The powder volume resistance of the metal oxide microparticles is preferably $10^5$ Ωcm to $10^{10}$ Ωcm.

When the powder volume resistance is less than $10^5$ Ωcm, the resistance as that of the undercoat layer lowers, which may cause the undercoat layer to failure in functioning as a charge blocking layer. For example, the powder volume resistance of metal oxide particles that have undergone conductive treatment such as formation of a tin oxide conductive layer doped with antimony is as extremely low as $10^0$ Ωcm to $10^1$ Ωcm. An undercoat layer using such a conductive layer is unusable, because it does not function as a charge blocking layer and deteriorates in chargeability as a characteristic of the photoreceptor to generate defects such as image fogging and black dots.

On the other hand, when the powder volume resistance of the titanium oxide microparticles is more than $10^{10}$ Ωcm, that is, when the powder volume resistance of the titanium oxide microparticles is equal to or larger than the volume resistance of the binder resin, the resistance as that of the undercoat layer is so high that transfer of carriers generated when light is applied is inhibited, increasing the residual potential and reducing photosensitivity.

The surface of the metal oxide microparticles to be used in the present invention is coated (covered) with anhydrous silicon dioxide.

When surface-untreated titanium oxide microparticles are used, for example, aggregation of the titanium oxide microparticles due to long-term use or storage of the coating solution for undercoat layer formation is unavoidable even if the titanium oxide microparticles are sufficiently dispersed in the coating solution. That leads to defects in the coating film and uneven coating in the formation of the undercoat layer to make carrier injection from the conductive support more likely via aggregates as well as generate an image defects. As a result, fine black dots will be generated even in the presence of the undercoat layer.

When conventionally proposed titanium oxide microparticles are used, that is, titanium oxide microparticles surface-treated with alumina in order to improve dispersibility in the undercoat layer are used, it is necessary to produce a large amount of coating solution for, for example, forming the undercoat layer on the conductive support by a dip coating process. In this case, dispersion process over a long period of time may cause reaggregation of the titanium oxide microparticles to generate black dots, leading to reduction in image quality.

This is considered because the alumina on the surface of the microparticles peels off due to dispersion process over a long period of time to lessen the effect of the surface treatment and cause reaggregation of the titanium oxide microparticles to generate an image defect and make carrier injection from the conductive support more likely, leading to generation of fine black dots.

In addition, such black dots will be more significant with long-term use under a high-temperature and high-humidity environment, leading to significant reduction in image quality.

Furthermore, in the case of the use of titanium oxide microparticles surface-treated with an organic compound including silane coupling agents such as an alkoxysilane compound; sililating agents obtained by combining silicon with a halogen atom, a nitrogen atom, a sulfur atom or the like; and general coupling agents such as a titanate coupling agent and an aluminum coupling agent, the resistance of the undercoat layer increases to reduce sensitivity variation due to humidity fluctuation but reduce the sensitivity itself, leading to generation of image fogging. In addition, occurrence of such a phenomenon is significant with repeated use, in particular.

In addition, in the case of the use of titanium oxide microparticles surface-treated with a combination of alumina and silicon dioxide for sufficient surface treatment, the undercoat layer is likely to be affected by humidity under various environments, induced by water of crystallisation contained in the silicon dioxide. As a result, the sensitivity of the photoreceptor is affected as well as the image quality is reduced.

Unlike these surface-treated metal oxide microparticles, the metal oxide microparticles coated with anhydrous silicon dioxide allow provision of photoreceptors having excellent stability, being free from reduction in sensitivity under various environments and free from black dots and image fogging, because the silicon dioxide does not contain water of crystallization and influence by humidity is limited. In addition, the coating with the anhydrous silicon dioxide is less likely to peel off in the dispersion process over a long period of time to prevent aggregation of the titanium oxide, allowing stable production of the coating solution and formation of a uniform undercoat layer.

The metal oxide microparticles preferably have anhydrous silicon dioxide in a proportion of 0.1% by weight to 50% by weight, and more preferably have anhydrous silicon dioxide in a proportion of 1% by weight to 40% by weight.

When the proportion of the anhydrous silicon dioxide (amount of surface treatment) is in the above-mentioned range, the effects of the present invention can be obtained more advantageously and influence by humidity fluctuation can be inhibited while maintaining electrical characteristics of the metal oxide particles, in particular, titanium oxide microparticles.

When the proportion of the anhydrous silicon dioxide is less than 0.1% by weight, the surface of the titanium oxide microparticles cannot be coated sufficiently to prevent the effect of the surface treatment from being produced sufficiently. When the proportion of the anhydrous silicon dioxide is more than 50% by weight, on the other hand, the effect of the addition of the titanium oxide microparticles is lessened and the effect of the addition of the silicon dioxide microparticles is produced, which may cause reduction in sensitivity of the photoreceptor and generation of image fogging.

For the metal oxide microparticles coated with anhydrous silicon dioxide, commercially available products can be used. Examples thereof include:

zinc oxide microparticles surface-treated with anhydrous silicon dioxide such as Maxlight ZS-032, product name, manufactured by Showa Denko K.K. (zinc oxide: 80% by weight, anhydrous silicon dioxide: 20% by weight); and titanium oxide microparticles surface-treated with anhydrous silicon dioxide such as Maxlight TS-04, product name, manufactured by Showa Denko K.K. (titanium oxide: 67% by weight, anhydrous silicon dioxide: 33% by weight) and Maxlight TS-043, product name, manufactured by Showa Denko K.K. (titanium oxide: 90% by weight, anhydrous silicon dioxide: 10% by weight).

Preferably, the metal oxide microparticles are contained in the undercoat layer in a ratio by weight between the metal oxide microparticles and the binder resin of 10:90 to 99:1, and more preferably in a ratio by weight of 30:70 to 99:1, and even more preferably in a ratio by weight of 35:65 to 95:5.

When the ratio by weight of the metal oxide microparticles is in the above-mentioned range, the effects of the present invention can be obtained more advantageously.

When the ratio by weight between the metal oxide microparticles and the binder resin is less than 10:90, the sensitivity of the photoreceptor may be reduced, and charges may be accumulated in the undercoat layer to increase the residual potential. This phenomenon is particularly significant in repetition properties under a low-temperature and low-humidity environment. On the other hand, when the ratio by weight between the metal oxide microparticles and the binder resin is more than 95:5, aggregates are likely to be generated in the undercoat layer, and, an image defect of fine black dots is likely to be generated. In this case, at the same time, the content of the binder resin is lowered, and therefore adhesion to the conductive support is reduced and the undercoat layer will be likely to peel off.

Examples of usable materials for the binder resin include the same materials as in the case of the formation of a monolayered undercoat layer of a resin in the art.

Specific examples thereof include polyethylene resins, polypropylene resins, polystyrene resins, acrylic resins, vinyl chloride resins, vinyl acetate resins, polyurethane resins, epoxy resins, polyester resins, melamine resins, silicon resins, butyral resins, polyamide resins, copolymer resins including two or more types of these repeat units, casein, gelatin, polyvinyl alcohol and ethylcellulose. Out of these resins, polyamide resins, butyral resins, and vinyl acetate resins, which are alcohol-soluble are preferable, and polyamide resins are particularly preferable. This is because, as characteristics of the binder resin, polyamide resins do not dissolve or swell with a solvent to be used when the photosensitive layer is formed on the undercoat layer, have excellent adhesion to the conductive support and flexibility, and have good affinity for the metal oxide microparticles contained in the undercoat layer to allow the metal oxide microparticles to well disperse and allow excellent storage stability of the dispersion. That is, use of a polyamide resin as the binder resin produces the effects of the present invention more advantageously and allows maintenance of the flexibility of the film, because the polyamide resin is easy to mix with the metal oxide microparticles and excellent in adhesion to the conductive support.

Out of the polyamide resins, alcohol-soluble nylon resins are particularly preferable. Preferable examples thereof include copolymer nylons such as of 6-nylon, 6,6-nylon, 6,10-nylon, 11-nylon, and 12-nylon; and modified nylons such as N-alkoxymethyl-modified nylon and N-alkoxyethyl-modified nylon.

The undercoat layer may be formed, for example, by dissolving or dispersing the metal oxide microparticles, the binder resin and an additive, as needed, in an organic solvent to prepare a coating solution for undercoat layer formation, and applying the coating solution onto the surface of the conductive support, and then drying the same to remove the organic solvent.

In order to disperse the metal oxide microparticles in the coating solution, the coating solution may be treated by using an ultrasonic dispersing machine without a dispersion medium or a general dispersing machine with a dispersion medium such as a ball mill, a bead mil and a paint conditioner. The latter dispersing machine is particularly preferable, because with the dispersing device, the metal oxide microparticles are put into a solution of the binder resin dissolved in the organic solvent, and the inorganic compound can be dispersed by the action of a strong force given by the dispersing machine via the dispersion medium.

Examples of the material of the dispersion medium include glass, zirconia, titania and alumina. Out of these materials, zirconia and titania are particularly preferable as having high abrasion resistance.

Glass is not preferable, because it increases the viscosity of the dispersion and reduces the storage stability.

This is considered based on the fact that the strong force given by the dispersing machine is used not only as energy for dispersing the metal oxide microparticles but also as energy for abrading the dispersion medium itself so that the material of the dispersion medium is mixed in the coating dispersion to deteriorate the coating dispersion in dispersibility and storage stability, having some influences on the coatability and the film quality in the formation of the undercoat layer.

The shape of the dispersion medium may be in the form of a bead having a size of 0.3 millimeters to several millimeters or in the form of a ball having a size of approximately several tens of millimeters.

As the organic solvent, general organic solvents used in the art may be used. When an alcohol-soluble polyamide resin, which is more preferable as the binder resin, is used, lower alcohols having 1 to 4 carbon atoms such as methyl alcohol, ethyl alcohol, isopropyl alcohol and n-propyl alcohol are particularly preferable.

As the method for applying the coating solution for undercoat layer formation, the most suitable method may be appropriately selected in consideration of physical properties of the coating solution and productivity. Examples thereof include a Baker applicator method, a bar-coater method, a casting method, a spin coating method, a nozzle method, a roll coating method and the like when the conductive support is a sheet; and a spray method, a vertical ring method, a dip coating method and the like when the conductive support is a drum.

Out of these application methods, the dip coating method is relatively simple and advantageous in terms of productivity and costs, and therefore can be suitably used for the production of the photoreceptor. In the dip coating method, a substrate is immersed in a vessel filled with the coating solution, and then raised at a constant rate or at a rate that changes successively to form a layer on the surface of the substrate. The device to be used for the dip coating method may be provided with a coating solution dispersing machine typified by an ultrasonic generator to stabilize the dispersibility of the coating solution.

Though not particularly limited, the film thickness of the undercoat layer is preferably 0.01 μm to 10 μm, and more preferably 0.05 μm to 5 μm. When the film thickness of the undercoat layer is in the above-mentioned range, the effects of the present invention can be obtained more advantageously, and the sensitivity does not deteriorate under a low-temperature and low-humidity environment, and generation of fine black dots can be inhibited effectively at high temperature.

When the film thickness of the undercoat layer is less than 0.01 m, the film does not substantially function as an undercoat layer and a uniform surface cannot be obtained by covering defects of the conductive support. Then, carrier injection from the conductive support and excess carrier inflow to the charge generation layer cannot be inhibited, leading to deterioration in the chargeability and generation of fine black dots. On the other hand, when the film thickness of the undercoat layer is more than 10 μm, formation of the undercoat layer by the dip coating method is difficult, and the sensitivity of the photoreceptor may be reduced.

With the photoreceptor having the undercoat layer formed, image defects derived from defects of the conductive support and image defects derived from aggregates or the like of the charge generation material can be prevented while maintaining predetermined electrical characteristics between the conductive support and the photosensitive layer. In the present invention, in particular, the photoreceptor is produced by using a phthalocyanine pigment as a charge generation material having photosensitivity at a long wavelength. When such a photoreceptor is mounted in an image forming apparatus of an inverse developing process, therefore, the image forming apparatus can have excellent image characteristics without suffering from fine black dots in an unexposed region, which is specific to the inverse development, due to decrease or elimination of surface charges in a micro area. In addition, since the surfaces of the metal oxide microparticles are treated with anhydrous silicon dioxide, which does not contain water of crystallization, influence by humidity is inhibited, and the sensitivity is not reduced significantly even under a low-humidity environment.

[Multilayered Photosensitive Layer 4]

The multilayered photosensitive layer 4 is composed of the charge generation layer 5 and the charge transport layer 6. Thus, a most suitable material for forming each layer can be independently selected by assigning a charge generation function and a charge transport function to separate layers.

[Charge Generation Layer 5]

The charge generation layer contains, as its main component, the charge generation material having a charge generation ability of absorbing applied light to generate charges and optionally contains a known additive and a binder resin (second binder resin).

The present invention uses two specific kinds of phthalocyanine compounds as the charge generation material, that is, a crystal type oxotitanylphthalocyanine having peaks in an X-ray diffraction spectrum with CuKα characteristic X-rays (0.15418 nm) at Bragg angles (2θ±0.2°) of 7.3°, 9.4°, 9.6°, 11.6°, 13.3°, 17.9°, 24.1° and 27.2°, in which a peak bundle formed by overlapping the peaks at 9.4° and 9.6° is a largest peak, and the peak at 27.2° is a second largest peak; and an X-type metal-free phthalocyanine having peaks in the X-ray diffraction spectrum at Bragg angles (2θ±0.2°) of 7.5°, 9.1°, 16.7°, 17.3° and 22.3°.

The crystal type oxotitanylphthalocyanine can be obtained by milling an oxotitaniumphthalocyanine in an organic solvent, as described later.

The oxotitaniumphthalocyanine is represented by the following formula (A):

(A)

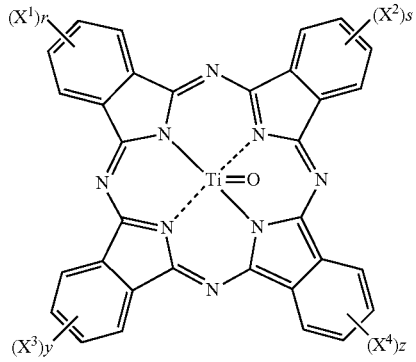

wherein $X^1$, $X^2$, $X^3$ and $X^4$, which may be the same or different, respectively represent a halogen atom, an alkyl group or an alkoxy group, and r, s, y, and z, which may be the same or different, respectively denote an integer from 0 to 4.

Examples of the halogen atom represented by $X^1$, $X^2$, $X^3$ or $X^4$ in the formula (A) include fluorine, chlorine, bromine and iodine atoms.

Examples of the alkyl group represented by $X^1$, $X^2$, $X^3$ or $X^4$ include alkyl groups having 1 to 4 carbon atoms such as a methyl group, ethyl group, n-propyl group, isopropyl group, n-butyl group, isobutyl group and t-butyl group.

Examples of the alkoxy group represented by $X^1$, $X^2$, $X^3$ or $X^4$ include alkoxy groups having 1 to 4 carbon atoms such as a methoxy group, ethoxy group, propoxy group, isopropoxy group, n-butoxy group, isobutoxy group and t-butoxy group.

The oxotitaniumphthalocyanine compound represented by the formula (A) may be manufactured by known production methods such as the method as described in Moser, Frank H and Arthur L. Thomas, "Phthalocyanine Compounds, Reinhold Publishing Corp., New York, 1963.

In the case of, for example, unsubstituted oxotitaniumphthalocyanine obtained when r, s, y, and z are 0 among the oxotitaniumphthalocyanine compounds represented by the formula (A), o-phthalylnitrile and titanium tetrachloride are melted by heating or reacted under heating in a proper solvent such as α-chloronaphthalene to synthesize dichlorotitaniumphthalocyanine, and then the dichlorotitaniumphthalocyanine is hydrolyzed using a base or water to obtain an unsubstituted oxotitaniumphthalocyanine.

In addition, the oxotitaniumphthalocyanine can also be produced by reacting 1,3-diiminoisoindoline with titanium tetraalkoxide such as tetrabutoxytitanium under heating in a proper solvent such as N-methylpyrrolidone.

The oxotitaniumphthalocyanine having a crystal structure to be used in the present invention can be obtained by milling the oxotitaniumphthalocyanine obtained by hydrolysis with mechanical stress or stirring the same for a sufficient period of time in an organic solvent such as methyl ethyl ketone, and the former way is preferable.

The oxotitaniumphthalocyanine having a crystal structure to be used in the present invention can also be obtained by treating an oxotitaniumphthalocyanine with an organic solvent that is immiscible in water such as dichloroethane in the presence of water.

Specific examples of the above-mentioned method include, but are not limited to, a method in which an oxotitaniumphthalocyanine swollen with water is treated with an organic solvent and a method in which water is added to an organic solvent and an oxotitaniumphthalocyanine, not swollen, is put therein.

Examples of the method in which an oxotitaniumphthalocyanine is swollen with water include, but are not limited to, a method in which an oxotitaniumphthalocyanine is dissolved in sulfuric acid and deposited in water into a form of a wet paste; and a method in which an oxotitaniumphthalocyanine is swollen with water into a form of a wet paste using a stirring or dispersing machine such as a homomixer, a paint mixer, a ball mill and a sand mill.

Basically, the X-type metal-free phthalocyanine has a structure of Formula (A) of a phthalocyanine without coordination of titanium and has an X-ray diffraction spectrum of an X type having the peaks as described above. For the X-type metal-free phthalocyanine, commercially available products such as Fastogen Blue 8120BS, product name, manufactured by DIC Corporation can be used, for example.

The particle diameters of the crystal type oxotitanylphthalocyanine and the X-type metal-free phthalocyanine may be set so that they are dispersed uniformly in the charge generation layer, and are usually approximately 10 nm to 100 nm.

Preferably, the X-type metal-free phthalocyanine is contained in the photosensitive layer in a proportion of 10% by weight, to 70% by weight with respect to the crystal type oxotitanylphthalocyanine, and more preferably in a proportion of 40% by weight to 70% by weight. When the X-type metal-free phthalocyanine is in the above-mentioned proportion, the most suitable sensitivity can be achieved, and the effects of the present invention can be obtained more advantageously. Besides, when the photoreceptor is exposed with a semiconductor laser whose light intensity distribution is a Gaussian distribution, the photoreceptor is subjected to exposure/potential decay only by strong light in a central part but is not subjected to potential decay by weak light in an outer part, thereby attaining higher resolution.

When the proportion of the X-type metal-free phthalocyanine is less than 10% by weight, high sensitivity that is attributed to the crystal type oxotitanylphthalocyanine will be predominant, which may lead to failure in attaining higher resolution. On the other hand, when the proportion of the X-type metal-free phthalocyanine is more than 70% by weight, the characteristics will not be different from those in the case where only the X-type metal-free phthalocyanine is contained, which may lead to reduction in sensitivity.

The charge generation layer can be formed by, for example, adding an organic solvent to the particles of the crystal type oxotitanylphthalocyanine and the X-type metal-free phthalocyanine, milling and dispersing the mixture with a general dispersing machine such as a ball mill, a Sand grinder, a paint shaker and an ultrasonic dispersing machine to prepare a coating solution for charge generation layer formation as in the case of the undercoat layer, applying this coating solution onto the surface of the undercoat layer as in the case of the undercoat layer, and drying the same to remove the organic solvent.

The other steps and conditions therefor are in accordance with those for the formation of the undercoat layer.

Examples of the organic solvent include halogenated hydrocarbons such as dichloromethane, dichloroethane and tetrachloropropane; ketones such as isophorone, methyl ethyl ketone, acetophenone and cyclohexanone; esters such as ethyl acetate, methyl benzoate and butyl acetate; ethers such as tetrahydrofuran (THF), dioxane, dibenzyl ether, 1,2-dimethoxyethane and dioxane; aromatic hydrocarbons such as benzene, toluene, xylene, mesitylene, tetralin, diphenylmethane, dimethoxybenzene and dichlorobenzene; sulfur-containing solvents such as diphenyl sulfide; fluorine type solvents such as hexafluoroisopropanol; aprotic polar solvents such as N,N-dimethylformamide and N,N-dimethylacetamide.

These solvents can be used independently or in combination of two or more kinds thereof.

The charge generation layer may contain a binder resin for the purpose of improving its binding property.

As the binder resin, resins used in the art and having a binding property may be used, and those having excellent compatibility with the charge generation material are preferable.

Specific examples thereof include polyester resins, polystyrene resins, polyurethane resins, phenol resins, alkyd resins, melamine resins, epoxy resins, silicone resins, acrylic resins, methacrylate resins, polycarbonate resins, polyarylate resins, phenoxy resins, polyvinyl butyral resins, polyvinyl formal resins, and copolymer resins including two or more repeat units that form the above-mentioned resins. Examples of the copolymer resins include isolating resins such as vinyl chloride/vinyl acetate copolymer resins, vinyl chloride/vinyl acetate/maleic anhydride copolymer resins and acrylonitrile/styrene copolymer resins. The binder resin is not limited to the above-mentioned resins, and any resin generally used in the art may be used as the binder resin. These binder resins can be used independently or in combination of two or more kinds thereof.

Though not particularly limited, the ratio by weight between the charge generation material and the binder resin is preferably 10:90 to 99:1 and more preferably 30:70 to 90:10.

When the ratio by weight between the charge generation material and the binder resin is less than 10:90, the sensitivity is reduced due to shortage in charge generation, and sufficient responsiveness may not be obtained. On the other hand, when the ratio by weight between the charge generation material and the binder resin is more than 99:1, the film strength is reduced and, at the same time, the dispersibility is reduced to increase coarse particles, which may make generation of fine black dots more likely.

The charge generation layer may contain an appropriate amount of one or more known additives selected from a chemical sensitizer, an optical sensitizer, an antioxidant, an ultraviolet absorber, a dispersion stabilizer, a sensitizer, a leveling agent (surface modifier), a plasticizer and the like to the extent that the preferable characteristics of the present invention will not be damaged. These additives may be contained in the charge transport layer to be described later or may be contained in both the charge generation layer and the charge transport layer.

The chemical sensitizer and the optical sensitizer improve the sensitivity of the photoreceptor and restrain rise in residual potential and fatigue caused by repeated use to thereby improve the electrical durability of the photoreceptor.

Examples of the chemical sensitizer include electron attractive materials including acid anhydrides such as succinic anhydride, maleic anhydride, phthalic anhydride and 4-chloronaphthalic acid anhydride; cyano compounds such as tetracyanoethylene and terephthalmalondinitrile; aldehydes such as 4-nitrobenzaldehyde; anthraquinones such as anthraquinone and 1-nitroanthraquinone; polycyclic or heterocyclic nitro compounds such as 2,4,7-trinitrofluorenone and 2,4,5,7-tetranitrofluorenone; diphenoquinone compounds, and macromolecular compounds obtained by polymerizing these electron attractive materials.

Examples of the optical sensitizer include organic photoconductive compounds such as xanthene type dyes, quinoline type pigments and copper phthalocyanine; triphenylmethane type dyes typified by Methyl Violet, Crystal Violet, Night Blue and Victoria Blue; acridine dyes typified by Erythrocin, Rhodamine B, Rhodamine 3R, Acridine Orange and Flapeocine; thiazine dyes typified by Methylene Blue and Methylene Green; oxazine dyes typified by Capri Blue and Meldola's Blue; cyanine dyes; styryl dyes; pyrylium salt dyes; and thiopyrylium salt dyes.

The antioxidant can maintain sensitivity stability for a long period of time.

Examples of the antioxidant include phenol type antioxidants, for example, hindered phenol such as 2,6-di-t-butyl-4-methylphenol(2,6-di-t-butyl-p-cresol: BHT), amine type antioxidants such as hindered amine, Vitamin E, hydroquinone, paraphenylenediamine, aryl alkanes and their derivatives, organic sulfur type compounds, and organic phosphorous compounds. These compounds may be used independently or in combination of two or more kind thereof.

The amount of the antioxidant to be added is preferably 0.1 parts by weight to 50 parts by weight, and more preferably 0.5 parts by weight to 15 parts by weight with respect to 100 parts by weight of the charge generation material.

When the amount of the antioxidant to be added is less than 0.1 parts by weight, sufficient effects on improvement in the storage stability of the coating solution and improvement in the durability of the photoreceptor may not be obtained. On the other hand, when the amount of the antioxidant to be added is more than 40 parts by weight, the characteristics of the photoreceptor may be adversely affected.

The leveling agent and the plasticizer can improve film-forming characteristics, flexibility, and surface smoothness.

Examples of the leveling agent include silicone oil, fluororesin, and the like.

Examples of the plasticizer include biphenyl, biphenyl chloride, benzophenone, o-terphenyl, dibasic acid ester, aliphatic acid ester, phosphate, phthalate ester, various fluoro hydrocarbon, paraffin chloride and epoxy plasticizers.

Though not particularly limited, the film thickness of the charge generation layer is preferably 0.05 μm to 5 μm, and more preferably 0.1 μm to 1 μm.

When the film thickness of the charge generation layer is less than 0.05 μm, the light absorption efficiency decreases, and the sensitivity may be reduced due to shortage in charge generation. On the other hand, when the film thickness of the charge generation layer is more than 5 μm, excessive charge transfer in the charge generation layer eliminates charges on the surface of the photoreceptor so vigorously that the chargeability may be reduced.

[Charge Transport Layer 6]

The charge transport layer contains, as its main components, a charge transfer material that receives and transfers charges generated by the charge generation material, and a binder resin.

As the charge transport material, a hole transport material and an electron transfer material that are used in the art can be used.

Examples of the hole transport material include carbazole derivatives, pyrene derivatives, oxazole derivatives, oxadiazole derivatives, thiazole derivatives, thiadiazole derivatives, triazole derivatives, imidazole derivatives, imidazolone derivatives, imidazolidine derivatives, bisimidazolidine derivatives, styryl compounds, hydrazone compounds, polycyclic aromatic compounds, indole derivatives, pyrazoline derivatives, oxazolone derivatives, benzimidazole derivatives, quinazoline derivatives, benzofuran derivatives, acridine derivatives, phenazine derivatives, aminostilbene derivatives, triarylamine derivatives, triarylmethane derivatives, phenylenediamine derivatives, stilbene derivatives, enamine derivative and benzidine derivatives, polymers having groups derived from these compounds on the main chain or side chain, for example, and poly-N-vinylcarbazole, poly-1-vinylpyrene, ethylcarbazole-formaldehyde resin, triphenylmethane polymer and poly-9-vinylanthracene, and polysilane.

Examples of the electron transfer material include organic compounds such as benzoquinone derivatives, tetracyano ethylene derivative, tetracyanoquinodimethane derivatives, fluorenone derivatives, xanthone derivatives, phenanthraquinone derivatives, phthalic anhydride derivative and diphenoquinone derivatives.

These charge transport materials may be used independently or in combination of two or more kinds thereof.

As the binder resin, transparent resins that do not absorb light from the exposure light source in the image forming apparatus may be used out of resins used in the art and having a binding property, and the same resins as contained in the charge generation layer may be used independently or in combination of two ore more kinds thereof.

Out of those mentioned, polystyrene resins, polycarbonate resins, polyarylate resins, and polyphenylene oxide resins are preferable as having a volume resistance of $10^{13}\Omega$ or more to show excellent electrical insulation properties and having excellent film-forming characteristics, potential characteristics and the like, among which polycarbonates are particularly preferable.

Though not particularly limited, the proportion of the binder resin is preferably 30 parts by weight to 200 parts by weight, and more preferably 60 parts by weight to 180 parts by weight with respect to 100 parts by weight of the charge transport material.

When the proportion of the binder resin is less than 30 parts by weight, abrasion loss of the photosensitive layer increases, and the printing durability may deteriorate. On the other hand, when the proportion of the binder resin is more than 200 parts by weight, sufficient responsiveness may not be obtained with the charge transport ability of the present charge transport material.

The charge transport layer may contain an appropriate amount of one or more known additives selected from a chemical sensitizer, an optical sensitizer, an antioxidant, an ultraviolet absorber, a dispersion stabilizer, a sensitizer, a leveling agent (surface modifier), a plasticizer, and microparticles of an inorganic compound or an organic compound to the extent that the preferable characteristics of the present invention will not be damaged.

As in the case of the charge generation layer, the charge transport layer can be formed by preparing a coating solution for charge transport layer formation and by using a wet process, in particular, a dip coating method.

As the organic solvent to be used for the preparation of the coating solution for charge transport layer formation, the same solvents as used for the preparation of the coating solution for charge generation layer formation may be used independently or in combination of two or more kinds thereof. As needed, a solvent such as alcohols, acetonitrile and methyl ethyl ketone may be further added to the solvent.

The other steps and conditions therefor are in accordance with those for the formation of the undercoat layer and the charge generation layer.

Though not particularly limited, the film thickness of the charge transport layer is preferably 5 μm to 50 μm, and particularly preferably 10 μm to 45 μm.

When film thickness of the charge transport layer is less than 5 μm, the charge retention ability may be reduced. On the other hand, when the film thickness of the charge transport layer is more than 50 μm, reduction in sharpness and a rise in residual potential are caused, which may result in significant image deterioration.

[Monolayered Photosensitive Layer 4']

The monolayered photosensitive layer contains, as its main components, two specific kinds of phthalocyanine compounds, that is, the crystal type oxotitanylphthalocyanine and the X-type metal-free phthalocyanine as the charge generation material; the above-described charge transport material; and a binder resin (binding agent).

The monolayered photosensitive layer may optionally contain the same additives as those contained in the charge generation layer in such an appropriate amount to the extent that the effects of the present invention will not be impaired.

In the monolayered photosensitive layer, the two specific kinds of phthalocyanine compounds are dispersed as the charge generation material in the charge transport layer formed according to the above-mentioned blending ratio. Accordingly, it is preferable that the particle diameter of the charge generation material is sufficiently small. Specifically, the particle diameter is preferably 1 μm or less, and more preferably approximately 10 nm to 100 nm.

When the amount of the charge generation material dispersed in the monolayered photosensitive layer is too small, the sensitivity will be insufficient, and when it is too large, deterioration in chargeability will be caused. Therefore, the charge generation material is preferably blended in a proportion of approximately 0.5% by weight to 50% by weight, and more preferably in a proportion of approximately 1% by weight to 20% by weight.

The monolayered photosensitive layer can be formed by dissolving and/or dispersing the charge generation material, the charge transport material and optional other additives in a proper organic solvent to prepare a coating solution for monolayered photosensitive layer formation, applying this coating solution onto the surface of the undercoat layer formed on the conductive support, and then drying the same to remove the organic solvent.

Other steps and conditions therefor are in accordance with those in the formation of the charge generation layer.

Though not particularly limited, the film thickness of the monolayered photosensitive layer is preferably 5 μm to 50 μm, and more preferably 15 μm to 40 μm.

When the film thickness of the monolayered photosensitive layer is less than 5 μm, the charge retention ability of the surface of the photoreceptor may be reduced. On the other hand, when the film thickness of the monolayered photosensitive layer is more than 50 μm, productivity may be reduced.

[Protective Layer (not Shown)]

The photoreceptor of the present invention may have a protective layer on the surface of the charge transport layer as a means for protecting the surface of the charge transport layer and limiting abrasive deterioration of the surface of the charge transport layer.

The protective layer is formed of a binder resin (thermoplastic resin and light or heat-curable resin) and, as needed, at least one kind of inorganic microparticles of the metal oxide microparticles as described above and organic microparticles including fluorine materials, and the content of the microparticles in the protective layer is preferably approximately 0.01% by weight to 3% by weight.

Further, it is preferable to add the above-described charge transport material and antioxidant in the protective layer according to need. Potential stability and image quality can be improved by the addition of these additives.

The temperature in the step of drying the coating film is not particularly limited, as long as the temperature allows removal of the used organic solvent, and is preferably 50° C. to 140° C., and particularly preferably 80° C. to 130° C.

When the drying temperature is less than 50° C., the drying time is prolonged, and a large amount of the solvent remains in the photosensitive layer to lead to deterioration in the electrical characteristics in repeated use, which may cause degradation of images to be obtained. On the other hand, when the drying temperature is more than 140° C., the charge generation material and the charge transport material are thermally deteriorated to deteriorate the electrical characteristics of the photoreceptor from an initial stage.

[Image Forming Apparatus]

The image forming apparatus of the present invention comprises at least: the photoreceptor of the present invention; a charging means for charging the photoreceptor; an exposure means for exposing the charged photoreceptor to form an electrostatic latent image; a developing means for developing the electrostatic latent image formed by the exposure to form a toner image; a transfer means for transferring the toner image formed by the development onto a recording material; a fixing means for fixing the transferred toner image onto the recording material to form an image; and a cleaning means for removing and recovering a toner left on the photoreceptor, wherein the exposure means is an exposure device that exposes a surface of the photoreceptor by using a semiconductor laser with a pixel density of 1200 dpi or more to form the electrostatic latent image.

The image forming apparatus of the present invention will be described in detail with reference to the drawings, on the premise that the present invention is not limited to the following embodiments.

Figure 3:
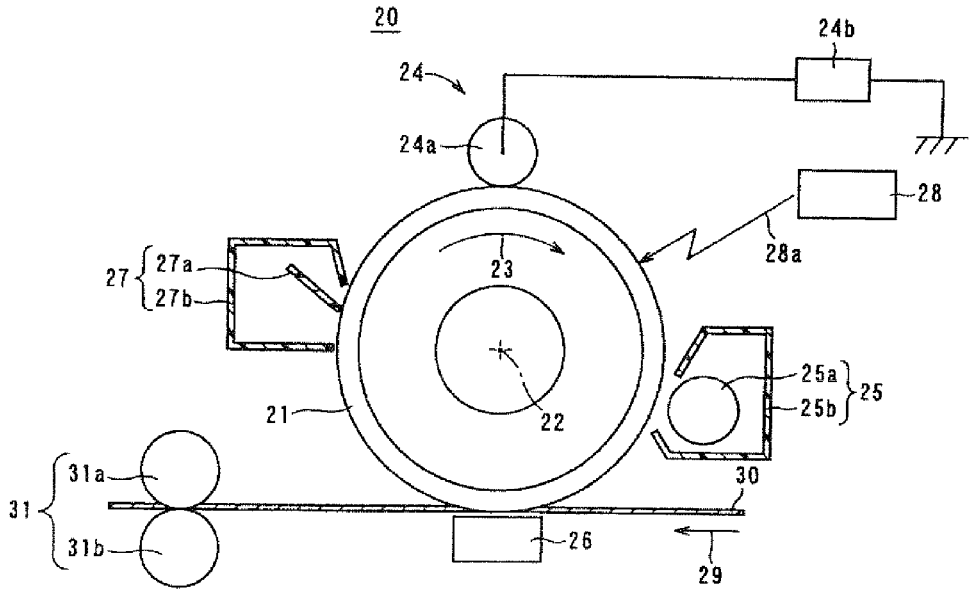
FIG. 3 is a schematic side view illustrating a structure of an image forming apparatus of the present invention.

FIG. 3 is a schematic side view illustrating a structure of an image forming apparatus according to the present invention.

The image forming apparatus 20 in FIG. 3 includes a photoreceptor 21 (for example, photoreceptor of FIG. 1 or 2) of the present invention, a charging means (charger) 24, an exposure means 28, a developing means (developing unit) 25, a transfer means (transfer unit) 26, a cleaning means (cleaner) 27, a fixing means (fixing unit) 31, and a discharge means (not shown, attached to the cleaning means 27). The reference numeral 30 represents a transfer paper.

The photoreceptor 21 is supported in a freely rotatable manner by the main body, not shown, of the image forming apparatus 20 and is driven to rotate in a direction of an arrow 23 around a rotating axis 22 by a drive means, not shown. The drive means has, for example, a structure including an electric motor and a reduction gear, and transmits its drive force to the conductive support constituting the core body of the photoreceptor 21 to thereby rotate the photoreceptor 21 at a predetermined peripheral speed. The charger 24, the exposure means 28, the developing unit 25, the transfer unit 26, and the cleaner 27 are disposed in this order towards a downstream side from an upstream side in the direction of the rotation of the photoreceptor 21 as shown by the arrow 23 along the outside peripheral surface of the photoreceptor 21.

The charger 24 is a charging means for charging the outside peripheral surface of the photoreceptor 21 to a predetermined potential. Specifically, the charger 24 is realized by, for example, a charge roller 24*a* of a contact type, a charge brush or a charger wire such as a corotron and a scorotron. The reference numeral 24*b* represents a bias power.

The exposure means 28 is provided with, for example, a semiconductor laser as its light source, and applies light 28*a* such as a laser beam emitted from the light source between the charger 24 and the developing unit 25 of the photoreceptor 21 to expose the outside peripheral surface of the charged photoreceptor 21 according to image information. The photoreceptor 21 is scanned repeatedly by the light 28*a* in a major scanning direction being a longitudinal direction of the rotating axis 22 of the photoreceptor 21 to form an electrostatic latent image one by one on the surface of the photoreceptor 21 by this scanning operation.

The developing unit 25 is a developing means that develops the electrostatic latent image formed by exposure on the surface of the photoreceptor 21 by a developer. The developing unit 25 is disposed facing the photoreceptor 21 and provided with a developing roller 25*a* that supplies a toner to the outside peripheral surface of the photoreceptor 21 and a casing 25*b* that supports the developing roller 25*a* in such a manner as to be rotatable around a rotating axis parallel to the rotating axis 22 of the photoreceptor 21 and that receives a developer containing the toner in its inside space.

The transfer unit 26 is a transfer means that transfers the toner image, which is a visible image formed on the outside peripheral surface of the photoreceptor 21 by the development, onto the transfer paper 30, which is a recording material (recording medium) supplied between the photoreceptor 21 and the transfer unit 26 from a direction of an arrow 29 by a conveying means, not shown. The transfer unit 26 is, for example, a non-contact type transfer means that is provided with a charging means and provides charges having inverse polarity with respect to the toner to the transfer paper 30 to thereby transfer the toner image onto the transfer paper 30.

The cleaner 27 is a cleaning means that removes and recovers the toner left on the outside peripheral surface of the photoreceptor 21 after the transfer operation using the transfer unit 26. The cleaner 27 is provided with a cleaning blade 27*a* that peels the toner left on the outside peripheral surface of the photoreceptor 21 and a recovery casing 27*b* that receives the toner peeled by the cleaning blade 27*a*. This cleaner 27 is disposed together with a discharge lamp, not shown.

The image forming apparatus 20 is also provided with the fixing unit 31, which is a fixing means that fixes the transferred image on the downstream side toward which the transfer paper 30 passing between the photoreceptor 21 and the transfer unit 26 is conveyed. The fixing unit 31 is provided with a heating roller 31*a* provided with a heating means, not shown, and a pressure roller 31*b* that is disposed facing the heating roller 31*a* and pressed by the heating roller 31*a* to form a contact part.

The image formation action of this image forming apparatus 20 is made as follows. First, when the photoreceptor 21 is rotated in the direction of the arrow 23 by the drive means, the surface of the photoreceptor 21 is positively or negatively charged uniformly to a predetermined potential by the charger 24 disposed on the upstream side to the image point of the light 28*a* from the exposure means 28 in the direction of the rotation of the photoreceptor 21.

Then, the surface of the photoreceptor 21 is irradiated with the light 28*a* emitted from the exposure means 28 according to image information. In the photoreceptor 21, as a result of the exposure, the surface charge on the part which is irradiated with the light 28*a* is removed, which causes a difference in surface potential between the part irradiated with the light 28*a* and the part not irradiated with the light 28*a*, resulting in the formation of an electrostatic latent image.

Then, the toner is supplied to the surface of the photoreceptor 21 on which the electrostatic latent image has been formed, from the developing unit 25 disposed on the downstream side to the image point of the light 28*a* of the exposure means 28 in the direction of the rotation of the photoreceptor 21, to develop the electrostatic latent image, thereby forming a toner image.

The transfer paper 30 is supplied between the photoreceptor 21 and the transfer unit 26 synchronously with the exposure for the photoreceptor 21. Charges having polarity opposite to that of the toner are provided to the supplied transfer paper 30 by the transfer unit 26 to transfer the toner image formed on the surface of the photoreceptor 21 onto the transfer paper 30.

Then, the transfer paper 30 where the toner image has been transferred is conveyed to the fixing unit 31 by the conveying means, and heated and pressurized when it passes through the contact part between the heating roller 31*a* and the pressure roller 31*b* of the fixing unit 31 to fix the toner image on the transfer paper 30, thereby forming a fast image. The transfer paper 30 on which an image is thus formed is discharged out of the image forming apparatus 20 by the conveying means.

In the meantime, the toner left on the surface of the photoreceptor 21 after the toner image is transferred by the transfer unit 26 is peeled from the surface of the photoreceptor 21 by the cleaner 27 and recovered. The charges on the surface of the photoreceptor 21 from which the toner is removed in this manner are removed by light emitted from the discharge lamp, so that the electrostatic latent image on the surface of the photoreceptor 21 disappears. Thereafter, the photoreceptor 21 is further driven to rotate, and then a series of the operations beginning with the charging operation are again repeated to form images continuously.

EXAMPLES

Hereinafter, the present invention will be described in detail by way of production examples, examples, comparative examples, and test examples, on the premise that the present invention is not limited to the following

Production Example 1

Production of Crystal Type oxotitanylphthalocyanine

An o-phthalodinitrile in an amount of 40 g and a titanium tetrachloride in an amount of 18 g were heated under stirring at 200° C. to 250° C. in 500 ml of α-chloronaphthalene in a nitrogen atmosphere for 3 hours to be reacted. Then, the reaction mixture was allowed to cool to 100° C. to 130° C. and filtered under heating, and a resulting solid was washed with 200 ml of α-chloronaphthalene heated to 100° C. to obtain 48.2 g of a crude product of dichlorotitanium-phthalocyanine. The resulting crude product was washed with 200 ml of α-chloronaphthalene, and then washed with 200 ml of methanol at room temperature, and further subjected to heat spray washing in 500 ml of methanol. The product was filtered, and then the resulting crude product was subjected to heat spray washing in 500 ml of water. This washing was repeated until the pH of the product became 6 to 7, and then the product was dried to obtain 46.5 g of an oxotitanylphthalocyanine intermediate crystal.

Then, 1.0 g of the obtained oxotitanylphthalocyanine intermediate crystal was mixed with 30 g of methyl ethyl ketone, milled together with 60 g of glass beads having a diameter of 2 mm for 5.0 hours using a paint conditioner (product by Red Level Company), washed with 1000 mL of methanol, and then dried to obtain 0.95 g of a crystal type oxotitanylphthalocyanine of the present invention.

The obtained crystal was analyzed by an X-ray diffraction method under the following conditions to obtain an X-ray diffraction spectrum.

Figure 4:
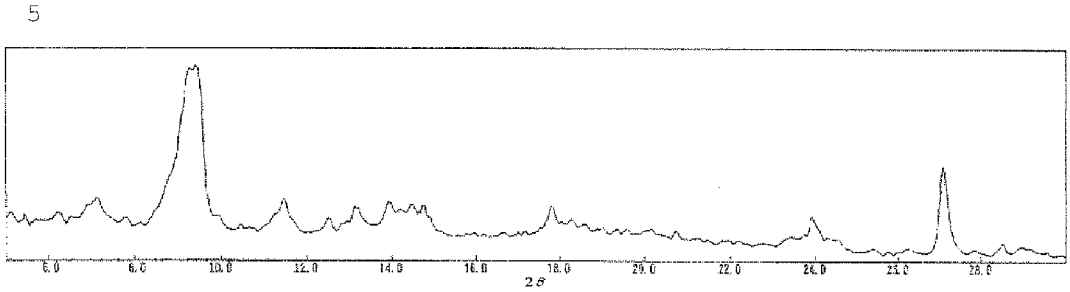
FIG. 4 is a drawing showing an X-ray diffraction spectrum of a crystal type oxotitaniumphthalocyanine of the present invention (Production Example 1).

FIG. 4 shows the X-ray diffraction spectrum.

| | |
|---|---|
| X-ray source | CuKα = 0.15418 nm |
| Voltage | 30 kV to 40 kV |
| Current | 50 mA |
| Start angle | 5.00° |
| Stop angle | 30.00° |
| Step angle | 0.01° to 0.020° |
| Measurement time | 2.0° to 0.5°/minute |
| Measuring method | θ/2θ scan |

Example 1

As the metal oxide microparticles, 1 part by weight of zinc oxide microparticles surface-treated with anhydrous silicon dioxide (product name: Maxlight ZS-032, manufactured by Showa Denko K.K., zinc oxide: 80% by weight, anhydrous silicon dioxide: 20% by weight) and, as the binder resin, 9 parts by weight of a polyamide resin (product name: Amilan CM8000, manufactured by Toray Industries, Inc.) were added to a mixed solvent of 500 parts by weight of methanol and 500 parts by weight of 1,3-dioxolane contained in a polypropylene container having a volume of 1000 mL. Further, as the dispersion medium, zirconia beads having a diameter of 1 mm were added up to half the volume of the polypropylene container and dispersed with a paint shaker for 20 hours. This production step was repeated to prepare 3000 mL of a coating solution for undercoat layer formation (metal oxide microparticles P/binder resin R=10/90).

A cylindrical aluminum support having a diameter of 30 mm and a total length of 340 mm as the conductive support was immersed in a coating vessel filled with the prepared coating solution for undercoat layer formation, raised, and then air dried to form an undercoat layer having a film thickness of 1 μm on the conductive support.

Subsequently, 10 parts by weight of the crystal type oxotitanylphthalocyanine produced in Production Example 1 and 5 parts by weight of an X-type Metal-free phthalocyanine having diffraction peaks in an X-ray diffraction spectrum at Bragg angles (2θ±0.2°) of 7.5°, 9.1°, 16.7°, 17.3° and 22.3° (product name: Fastogen Blue 8120BS, manufactured by DIC Corporation) as the charge generation material, and 10 parts by weight of a butyral resin (product name: S-LEC BL-1, manufactured by Sekisui Chemical Co., Ltd.) as the binder resin were mixed in 980 parts by weight of methyl ethyl ketone and dispersed with a paint shaker for 5 hours to prepare a coating solution for charge generation layer formation (proportion of the X-type metal-free phthalocyanine with respect to the crystal type oxotitanylphthalocyanine in the charge generation material: 50%).

The prepared coating solution for charge generation layer formation was applied onto the undercoat layer formed previously by the same dip coating method as in the formation of the undercoat layer and air dried to form a charge generation layer having a film thickness of 0.5 μm.

Subsequently, 10 parts by weight of a hydrazone compound represented by the following structural formula (I) as the charge transport material, 16 parts by weight of a polycarbonate resin (product name: lupilon Z400, manufactured by Mitsubishi Engineering-Plastics Corporation) as the binder resin, 0.0032 parts by weight of a dimethylpolysiloxane (product name: KF-96, manufactured by Shin-Etsu Chemical Co., Ltd.) as a leveling agent, and 0.5 parts by weight of a phenol type antioxidant (product name: SUMILIZER BHT, manufactured by Sumitomo Chemical Co., Ltd.) were mixed in 106 parts by weight of tetrahydrofuran to prepare a coating solution for charge transport layer formation having a solid concentration of 20% by weight.

The prepared coating solution for charge transport layer formation was applied onto the previously formed charge generation layer by the same dip coating method as in the case of the formation of the undercoat layer, and dried at 120° C. for 1 hour with hot air to form a charge transport layer having a film thickness of 23 μm, thereby obtaining a photoreceptor having the structure illustrated in FIG. 1.

(I)

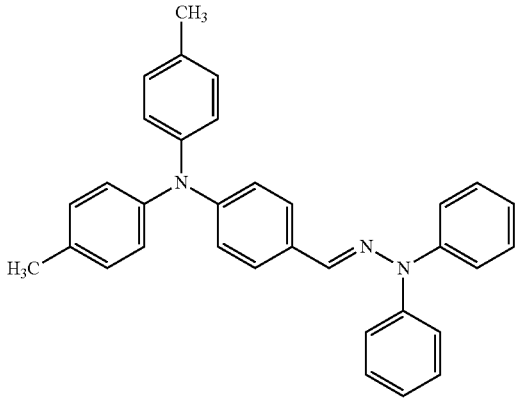

Example 2

A photoreceptor of Example 2 was obtained in the same manner as in Example 1 except that 1 part by weight of titanium oxide microparticles surface-treated with anhydrous silicon dioxide (titanium oxide: 67% by weight, anhydrous silicon dioxide: 33% by weight, product name: Maxlight TS-04, manufactured by Showa Denko K.K.) were used as the metal oxide microparticles instead of 1 part by weight of zinc oxide microparticles surface-treated with anhydrous silicon dioxide.

Example 3

A photoreceptor of Example 3 was obtained in the same manner as in Example 1 except that 1 part by weight of titanium oxide microparticles surface-treated with anhydrous silicon dioxide (titanium oxide: 90% by weight, anhydrous silicon dioxide: 10% by weight, product name: Maxlight TS-043, manufactured by Showa Denko K.K.) were used as the metal oxide microparticles instead of 1 part by weight of zinc oxide microparticles surface-treated with anhydrous silicon dioxide.

Example 4

A photoreceptor of Example 4 was obtained in the same manner as in Example 3 except that 9.5 parts by weight of titanium oxide microparticles surface-treated with anhydrous silicon dioxide (titanium oxide: 90% by weight, anhydrous silicon dioxide: 10% by weight, product name: Maxlight TS-043, manufactured by Showa Denko K.K.) as the metal oxide microparticles and 0.5 parts by weigh of a polyamide resin (product name: Amilan CM8000, manufactured by Toray Industries, Inc.) as the binder resin were used, and P/R=10/90 was changed to 95/5.

Example 5

A photoreceptor of Example 5 was obtained in the same manner as in Example 3 except that 0.5 parts by weight of titanium oxide microparticles surface-treated with anhydrous silicon dioxide (titanium oxide: 90% by weight, anhydrous silicon dioxide: 10% by weight, product name: Maxlight TS-043, manufactured by Showa Denko K.K.) as the metal oxide microparticles and 9.5 parts by weigh of a polyamide resin (product name: Amilan CM8000, manufactured by Toray Industries, Inc.) as the binder resin were used, and P/R=10/90 was changed to 5/95.

Example 6

A photoreceptor of Example 6 was obtained in the same manner as in Example 3 except that 9.9 parts by weight of titanium oxide microparticles surface-treated with anhydrous silicon dioxide (titanium oxide: 90% by weight, anhydrous silicon dioxide: 10% by weight, product name: Maxlight TS-043, manufactured by Showa Denko K.K.) as the metal oxide microparticles and 0.1 parts by weigh of a polyamide resin (product name: Amilan CM8000, manufactured by Toray Industries, Inc.) as the binder resin were used, and P/R=10/90 was changed to 99/1.

Example 7

A photoreceptor of Example 7 was obtained in the same manner as in Example 1 except that 8 parts by weight of titanium oxide microparticles surface-treated with anhydrous silicon dioxide (titanium oxide: 90% by weight, anhydrous silicon dioxide: 10% by weight, product name: Maxlight TS-043, manufactured by Showa Denko K.K.) were used as the metal oxide microparticles instead of 1 part by weight of zinc oxide microparticles surface-treated with anhydrous silicon dioxide, 2 parts by weight of a polyamide resin (product name: X1010, manufactured by Daicel-Degussa Ltd. (currently, Daicel-Evonik Ltd.) was used as the binder resin (P/R=80/20), and the film thickness of the undercoat layer was changed to 0.05 μm, Example 8

A photoreceptor of Example 8 was obtained in the same manner as in Example 7 except that the film thickness of the undercoat layer was changed to 5 μm.

Example 9

A photoreceptor of Example 9 was obtained in the same manner as in Example 7 except that the film thickness of the undercoat layer was changed to 0.01 μm.

Example 10

A photoreceptor of Example 10 was obtained in the same manner as in Example 7 except that the film thickness of the undercoat layer was changed to 12 μm.

Example 11

To a stirring tank having a volume of 100000 mL, 4 parts by weight of titanium oxide microparticles surface-treated with anhydrous silicon dioxide (titanium oxide: 90% by weight, anhydrous silicon dioxide: 10% by weight, product name: Maxlight TS-043, manufactured by Showa Denko K.K.) and 4 parts by weight of titanium oxide microparticles surface-treated with $Al_2O_3$ and $SiO_2.nH_2O$ (titanium oxide: 90% by weight, $Al(OH)_3$: 5% by weight, $SiO_2.nH_2O$: 5% by weight, product name: MT-500SA, manufactured by Tayca Corporation) as the metal oxide microparticles (ratio between the two kinds of metal oxide microparticles: 5/5), and 2 parts by weight of a polyamide resin (product name: X1010, manufactured by Daicel-Degussa Ltd. (currently Daicel-Evonik Ltd.) as the binder resin were put in together with a mixed solvent of 600 parts by weight of methanol, 300 parts by weight of tetrahydrofuran and 100 parts by weight of n-propanol. Further, silicon nitride beads having a diameter of 0.5 mm as a dispersion medium were put into a horizontal bead mil having a volume of 16500 mL in an amount up to 80% of the volume of the main body of the bead mill. Subsequently, the mixed solution was sent to the main body of the dispersing machine from the stirring tank through a diaphram pump and dispersed under circulation for 15 hours to prepare 64000 mL of a coating solution for undercoat layer formation (P/R=80/20).

A cylindrical aluminum support having a diameter of 30 mm and a total length of 340 mm as a conductive support was immersed in a coating vessel filled with the prepared coating solution for undercoat layer formation, raised, and then air dried to form an undercoat layer having a film thickness of 1 μm on the conductive support.

Subsequently, 10 parts by weight of the crystal type oxotitanylphthalocyanine produced in Production Example 1 and 5 parts by weight of an X-type metal-free phthalocyanine having diffraction peaks in an X-ray diffraction spectrum at Bragg angles (2θ±0.2°) of 7.5°, 9.1°, 16.7°, 17.3° and 22.3° (product name: Fastogen Blue 8120BS, manufactured by DIC Corporation) as the charge generation material, and 10 parts by weight of a butyral resin (product S-LEC BM-S, manufactured by Sekisui Chemical Co., Ltd.) as the binder resin were mixed in 985 parts by weight of methyl ethyl ketone and dispersed with a paint shaker for 5 hours to prepare a coating solution for charge generation layer formation (proportion of the X-type metal-free phthalocyanine in the charge generation material: 50%).

The prepared coating solution for charge generation layer formation was applied onto the undercoat layer formed previously by the same dip coating method as in the formation of the undercoat layer and air dried to form a charge generation layer having a film thickness of 0.5 μm.

Subsequently, 10 parts by weight of an enamine compound represented by the following structural formula (II) as the charge transport material, 16 parts by weight of a polycarbonate resin (product name: lupilon Z400, manufactured by Mitsubishi Engineering-Plastics Corporation) as the binder resin, 0.0032 parts by weight of a dimethylpolysiloxane (product name: KF-96, manufactured by Shin-Etsu Chemical Co., Ltd.) as a leveling agent, and 0.5 parts by weight of a phenol type antioxidant (product name: SUMILIZER BHT manufactured by Sumitomo Chemical Co., Ltd.) were mixed in 106 parts by weight of tetrahydrofuran to prepare a coating solution for charge transport layer formation having a solid concentration of 20% by weight.

The prepared coating solution for charge transport layer formation was applied onto the previously formed charge generation layer by the same dip coating method as in the case of the formation of the undercoat layer, and dried at 120° C. for 1 hour with hot air to form a charge transport layer having a film thickness of 23 μm, thereby obtaining a photoreceptor of Example 11 having the multilayered structure illustrated in FIG. 1.

(II)

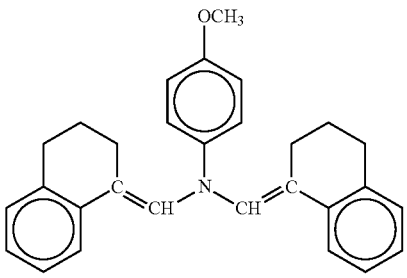

Example 12

An undercoat layer having a film thickness of 1 μm was formed on a conductive support in the same manner as in Example 11.

Subsequently, 10 parts by weight of the crystal type oxotitanylphthalocyanine produced in Production Example 1 and 5 parts by weight of an X-type metal-free phthalocyanine having diffraction peaks in an X-ray diffraction spectrum at Bragg angles (2θ±0.2°) of 7.5°, 9.1°, 16.7°, 17.3° and 22.3° (product name: Fastogen Blue 8120BS, manufactured by DIC Corporation) as the charge generation material were mixed in 185 parts by weight of tetrahydrofuran and dispersed with a paint shaker for 5 hours.

In the obtained mixture, 10 parts by weight of an enamine compound represented by the structural formula (II) as the charge transport material, 10 parts by weight of a diphenoquinone compound represented by the following structural formula (III), 16 parts by weight of a polycarbonate resin (product name: TS2050, manufactured by Teijin Ltd.), 0.0032 parts by weight of a dimethylpolysiloxane (product name: KF-96, manufactured by Shin-Etsu Chemical Co., Ltd.) as a leveling agent, and 0.5 parts by weight of a phenol type antioxidant (product name: SUMILIZER BHT, manufactured by Sumitomo Chemical Co., Ltd.) were mixed with tetrahydrofuran as a solvent to prepare a coating solution for photosensitive layer formation having a solid concentration of 21% by weight.

The prepared coating solution for photosensitive layer formation was applied onto the previously formed undercoat layer by the same dip coating method as in the case of the formation of the undercoat layer, and dried at 120° C. for 1 hour with hot air to form a photosensitive layer having a film thickness of 23 μm, thereby obtaining a photoreceptor of Example 12 having the monolayered structure illustrated in FIG. 2.

(III)

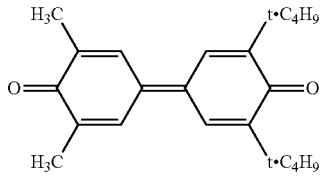

Example 13

A photoreceptor of Example 13 was obtained in the same manner as in Example 11 except that the amount of the X-type metal-free phthalocyanine was changed from 5 parts by weight to 7 parts by weight, while the amount of the crystal type oxotitanylphthalocyanine was unchanged from 10 parts by weight (proportion of the X-type metal-free phthalocyanine with respect to the crystal type oxotitanylphthalocyanine: 70%) as the charge generation material, and the amount of the butyral resin (product name: S-LEC BM-S, manufactured by Sekisui Chemical Co., Ltd.) was changed to 11.3 parts by weight as the binder resin.

Example 14

A photoreceptor of Example 14 was obtained in the same manner as in Example 11 except that the amount of the X-type metal-free phthalocyanine was changed from 5 parts by weight to 1 part by weight, while the amount of the crystal type oxotitanylphthalocyanine was unchanged from 10 parts by weight (proportion of the X-type metal-free phthalocyanine with respect to the crystal type oxotitanylphthalocyanine: 10%) as the charge generation material, and the amount of the butyral resin (product name: S-LEC BM-S, manufactured by Sekisui Chemical Co., Ltd.) was changed to 7.3 parts by weight as the binder resin.

Example 15

A photoreceptor of Example 15 was obtained in the same manner as in Example 11 except that the amount of the X-type metal-free phthalocyanine was changed from 5 parts by weight to 8 parts by weight, while the amount of the crystal type oxotitanylphthalocyanine was unchanged from 10 parts by weight (proportion of the X-type metal-free phthalocyanine with respect to the crystal type oxotitanylphthalocyanine: 80%) as the charge generation material, and the amount of the butyral resin (product name: S-LEC BM-S, manufactured by Sekisui Chemical Co., Ltd.) was changed to 12 parts by weight as the binder resin.

Example 16

A photoreceptor of Example 16 was obtained in the same manner as in Example 11 except that the amount of the X-type metal-free phthalocyanine was changed from 5 parts by weight to 0.5 parts by weight, while the amount of the crystal type oxotitanylphthalocyanine was unchanged from 10 parts by weight (proportion of the X-type metal-free phthalocyanine with respect to the crystal type oxotitanylphthalocyanine: 5%) as the charge generation material, and the amount of the butyral resin (product name: S-LEC BM-S, manufactured by Sekisui Chemical Co., Ltd.) was changed to 7 parts by weight as the binder resin.

Comparative Example 1

A photoreceptor of Comparative Example 1 was obtained in the same manner as in Example 1 except that 1 part by weight of zinc oxide microparticles surface-treated with alumina.organic polysiloxane (zinc oxide: 80% by weight, alumina.organic polysiloxane: 20% by weight, product name: FINEX-30W-LP2, manufactured by Sakai Chemical Industry Co., Ltd.) were used as the metal oxide microparticles instead of 1 part by weight of zinc oxide microparticles surface-treated with anhydrous silicon dioxide.

Comparative Example 2

A photoreceptor of Comparative Example 2 was obtained in the same manner as in Example 3 except that 1 part by weight of surface-untreated titanium oxide microparticles (product name: TTO-55N, manufactured by Ishihara Sangyo Kaisha, Ltd.) were used as the metal oxide microparticles instead of 1 part by weight of titanium oxide microparticles surface-treated with anhydrous silicon dioxide.

Comparative Example 3

A photoreceptor of Comparative Example 3 was obtained in the same manner as in Example 3 except that 1 part by weight of surface-untreated silicon dioxide microparticles (product name: UFP-80, manufactured by Denki Kagaku Kogyo K. K.) were used as the metal oxide microparticles instead of 1 part by weight of titanium oxide microparticles surface-treated with anhydrous silicon dioxide.

Comparative Example 4

A photoreceptor of Comparative Example 4 was obtained in the same manner as in Example 11 except that 15 parts by weight of an X-type metal-free phthalocyanine having diffraction peaks in an X-ray diffraction spectrum at Bragg angles (2θ±0.2°) of 7.5°, 9.1°, 16.7°, 17.3° and 22.3° (product name: Fastogen Blue 8120BS, manufactured by DIC Corporation) was solely used as the charge generation material.

Comparative Example 5

A photoreceptor of Comparative Example 5 was obtained in the same manner as in Example 11 except that 15 parts by weight of a τ-type metal-free phthalocyanine (product name: Liophoton TPA, manufactured by Toyo Ink Mfg. Co., Ltd.) was solely used as the charge generation material.

Comparative Example 6

A photoreceptor of Comparative Example 6 was obtained in the same manner as in Example 11 except that 15 parts by weight of the crystal type oxotitanylphthalocyanine produced in Production Example 1 was solely used as the charge generation material.

Table 1 summarizes details of the undercoat layers and the charge generation materials in the photoreceptors of Examples 1 to 16 and Comparative Examples 1 to 6.

TABLE 1

| | Undercoat layer | | | | | Charge generation material | | |
|---|---|---|---|---|---|---|---|---|
| | Metal oxide microparticles | Surface treatment | Amount of treatment (%) | P/R | Film thickness (μm) | crystal type phthalo-cyanine | metal-free phthalo-cyanine | Proportion of X type (%) |
| Example 1 | ZnO | Anhydrous $SiO_2$ | 20 | 10/90 | 1 | Contained | X type | 50 |
| Example 2 | $TiO_2$ | Anhydrous $SiO_2$ | 33 | 10/90 | 1 | Contained | X type | 50 |
| Example 3 | $TiO_2$ | Anhydrous $SiO_2$ | 10 | 10/90 | 1 | Contained | X type | 50 |
| Example 4 | $TiO_2$ | Anhydrous $SiO_2$ | 10 | 95/5 | 1 | Contained | X type | 50 |
| Example 5 | $TiO_2$ | Anhydrous $SiO_2$ | 10 | 5/95 | 1 | Contained | X type | 50 |
| Example 6 | $TiO_2$ | Anhydrous $SiO_2$ | 10 | 99/1 | 1 | Contained | X type | 50 |
| Example 7 | $TiO_2$ | Anhydrous $SiO_2$ | 10 | 80/20 | 0.05 | Contained | X type | 50 |
| Example 8 | $TiO_2$ | Anhydrous $SiO_2$ | 10 | 80/20 | 5 | Contained | X type | 50 |
| Example 9 | $TiO_2$ | Anhydrous $SiO_2$ | 10 | 80/20 | 0.01 | Contained | X type | 50 |
| Example 10 | $TiO_2$ | Anhydrous $SiO_2$ | 10 | 80/20 | 12 | Contained | X type | 50 |
| Example 11 | 2 kinds of $TiO_2$ | Anhydrous $SiO_2/Al_2O_3$ & $SiO_2 \cdot nH_2O$ = 5/5 | 10 | 80/20 | 1 | Contained | X type | 50 |
| Example 12 ※monolayer | 2 kinds of $TiO_2$ | Anhydrous $SiO_2/Al_2O_3$ & $SiO_2 \cdot nH_2O$ = 5/5 | 10 | 80/20 | 1 | Contained | X type | 50 |
| Example 13 | 2 kinds of $TiO_2$ | Anhydrous $SiO_2/Al_2O_3$ & $SiO_2 \cdot nH_2O$ = 5/5 | 10 | 80/20 | 1 | Contained | X type | 70 |
| Example 14 | 2 kinds of $TiO_2$ | Anhydrous $SiO_2/Al_2O_3$ & $SiO_2 \cdot nH_2O$ = 5/5 | 10 | 80/20 | 1 | Contained | X type | 10 |
| Example 15 | 2 kinds of $TiO_2$ | Anhydrous $SiO_2/Al_2O_3$ & $SiO_2 \cdot nH_2O$ = 5/5 | 10 | 80/20 | 1 | Contained | X type | 80 |
| Example 16 | 2 kinds of $TiO_2$ | Anhydrous $SiO_2/Al_2O_3$ & $SiO_2 \cdot nH_2O$ = 5/5 | 10 | 80/20 | 1 | Contained | X type | 5 |
| Comparative Example 1 | ZnO | Alumina organic polysiloxane | 20 | 10/90 | 1 | Contained | X type | 50 |
| Comparative Example 2 | $TiO_2$ | Untreated | — | 10/90 | 1 | Contained | X type | 50 |
| Comparative Example 3 | $SiO_2$ | Untreated | — | 10/90 | 1 | Contained | X type | 50 |
| Comparative Example 4 | 2 kinds of $TiO_2$ | Anhydrous $SiO_2/Al_2O_3$ & $SiO_2 \cdot nH_2O$ = 5/5 | 10 | 80/20 | 1 | — | X type | — |
| Comparative Example 5 | 2 kinds of $TiO_2$ | Anhydrous $SiO_2/Al_2O_3$ & $SiO_2 \cdot nH_2O$ = 5/5 | 10 | 80/20 | 1 | — | τ type | — |
| Comparative Example 6 | 2 kinds of $TiO_2$ | Anhydrous $SiO_2/Al_2O_3$ & $SiO_2 \cdot nH_2O$ = 5/5 | 10 | 80/20 | 1 | Contained | — | — |

(Test 1)

Evaluation Under High-Temperature and High-Humidity Environment, and Low-Temperature and Low-Humidity Environment The photoreceptors of Examples 1 to 16 and Comparative Examples 1 to 6 were evaluated for the sensitivity, presence/absence of a defect of fine black dots and the resolution under a high-temperature and high-humidity environment of a temperature of 35° C. and a relative humidity of 85%, and a low-temperature and low-humidity environment of a temperature of 5° C. and a relative humidity of 10%.

A commercially available digital copying machine (model: AR-451S, manufactured by Sharp Kabushiki kaisha) was modified to be capable of outputting dots at resolution of 1200 dpi and provided with a surface potentiometer (model: MODEL 344, manufactured by Treck Japan KK) to be capable of measuring the photoreceptors for the surface potential in the image formation process to obtain a high-resolution digital copying machine for evaluation.

Each photoreceptor is mounted in the copying machine and measured for the surface potential immediately after the charge operation by the charger as a charge potential V0 (V) and the surface potential immediately after the exposure as a residual potential VL (V) under a high-temperature and high-humidity environment and a low-temperature and low-humidity environment.

Table 2 shows the results obtained.

The presence/absence of the defect of fine black dots was evaluated with a white solid image by changing the charge potential from a normal setting of −650 V to a maximum value of −850 V and changing the development potential from a normal setting of −500 V to −700 V, and adjusting the machine toward more significant fine black dots under a high-temperature and high-humidity environment.

The resolution was evaluated by performing visual observation on an output image printed out after transmitting a data that requires wiring of 1 white dot in a black solid image (data that requires a laser to perform entire scanning to turn only 1 dot off) prepared using a personal computer to the copying machine via a printer interface.

The obtained results were evaluated in accordance with the following criteria.

A: Excellent No fine black dots observed, and dot reproducible.

B: Good Minimal fine black dots observed but no problem for practical use, and dot reproducible.

C: Pass Some fine black dots observed, relatively low density, or inferior in dot reproduction but usable F: Fail Many black dots observed, dot unreproducible, or quite low density Table 2 shows the results obtained. The image evaluation results include details thereof.

TABLE 2

| | Evaluation under high-temperature and high-humidity environment | | | Evaluation under low-temperature and low-humidity environment | | |
|---|---|---|---|---|---|---|
| | V0 | VL | Result of image evaluation | V0 | VL | Result of image evaluation |
| Example 1 | −650 | −96 | B | −651 | −113 | B |
| Example 2 | −653 | −96 | A | −653 | −115 | A |
| Example 3 | −650 | −94 | A | −651 | −112 | A |
| Example 4 | −648 | −89 | B | −650 | −107 | A |
| Example 5 | −652 | −97 | B | −650 | −121 | C (relatively low density) |
| Example 6 | −640 | −83 | C (a few black dots, partly peeled) | −645 | −104 | B (partly peeled) |
| Example 7 | −648 | −90 | B | −650 | −107 | A |
| Example 8 | −654 | −99 | A | −653 | −116 | B |
| Example 9 | −643 | −88 | C (a few black dots, inferior in dot reproduction) | −645 | −103 | B |
| Example 10 | −654 | −114 | B | −652 | −125 | C (relatively low density) |
| Example 11 | −650 | −95 | A | −651 | −113 | A |
| Example 12 monolayer | −645 | −89 | B | −648 | −105 | A |
| Example 13 | −651 | −99 | A | −650 | −115 | B |
| Example 14 | −650 | −92 | B | −650 | −110 | B |
| Example 15 | −650 | −110 | B | −650 | −125 | C (relatively low density) |
| Example 16 | −650 | −93 | C (a few black dots, inferior in dot reproduction) | −651 | −110 | B |
| Comparative Example 1 | −640 | −135 | F (fogging, poor in dot reproduction) | −648 | −235 | F (low density) |
| Comparative Example 2 | −655 | −108 | F (many black dots, poor in dot reproduction) | −650 | −192 | F (low density) |
| Comparative Example 3 | −648 | −133 | F (many black dots, low density) | −649 | −210 | F (low density) |
| Comparative Example 4 | −651 | −130 | C (relatively low density) | −651 | −240 | F (low density) |
| Comparative Example 5 | −651 | −133 | C (relatively low density) | −652 | −250 | F (low density) |
| Comparative Example 6 | −650 | −91 | F (poor in dot reproduction, many black dots) | −650 | −109 | F (poor in dot reproduction) |

The results shown in Table 2 have revealed the following:

(1) The photoreceptors in which the undercoat layer contains metal oxide microparticles coated with anhydrous silicon dioxide, and the charge generation layer contains a crystal type oxotitanylphthalocyanine having specific X-ray diffraction peaks and an X-type metal-free phthalocyanine as the charge generation material (Examples 1 to 16) are excellent in stability to environmental fluctuation and applicable to a high-resolution machine that is not optically decayed by weak exposure but is optically decayed only by strong light.

(2) The photoreceptors in which the ratio P/R between the metal oxide microparticles P and the binder resin R is 10/90 to 95/5, the film thickness of the undercoat layer is 0.05 μm to 5 μm, and the proportion of the X-type metal-free phthalocyanine with respect to the crystal type oxotitanylphthalocyanine is 10% by weight to 70% by weight are good in terms of sensitivity, prevention of fine black dots and resolution under any environment, and the photoreceptors using titanium oxide are particularly excellent (Examples 1 to 4, 7, 8 and 11 to 14).

(3) The photoreceptors that do not meet the conditions described in (2) are still applicable to an image forming apparatus of a high resolution of 1200 dpi under any environment, though they are slightly inferior in terms of generation of fine black dots under a high-temperature and high-humidity environment, lowering of the density under a low-temperature and low-humidity environment, and dot reproducibility (Examples 5, 6, 9, 10, 15 and 16).

(4) With the photoreceptor having an undercoat layer containing metal oxide microparticles (zinc oxide) coated with alumina.organic polysiloxane instead of anhydrous silicon dioxide, charge characteristics are poor under a high-temperature and high-humidity environment, and more fogging and fine black dots are generated in a white solid image, preventing accurate one-dot reproduction (Comparative Example 1).

(5) With the photoreceptor having an undercoat layer containing surface-untreated metal oxide microparticles (titanium oxide), more fine black dots are generated particularly under a high-temperature and high-humidity environment due to aggregation of the metal oxide microparticles (Comparative Example 2).

(6) With the photoreceptor having an undercoat layer containing surface-untreated metal oxide microparticles (silicon dioxide), the sensitivity is poor under a high-temperature and high-humidity environment, and fine black dots are generated due to aggregation, though it is not so much as those with the photoreceptor described in (5) (this example is corresponding to the case where the amount of the surface treatment for the metal oxide microparticles exceeds the upper limit prescribed for the present invention) (Comparative Example 3).

(7) With the photoreceptors described in (4) to (6), one-dot reproduction at 1200 dpi is attempted, but fine black dots are generated to prevent constant and accurate one-dot reproduction in many cases, and the sensitivity itself is poor particularly under a low-temperature and low-humidity environment, and the image density is low (Comparative Examples 1 to 3).

(8) The photoreceptors in which the charge generation material consists only of a τ-type metal-free phthalocyanine or only of an X-type metal-free phthalocyanine tend to allow satisfactory dot reproduction because of their low sensitivity, but the density in a black solid image is low, and the image is insufficient particularly under a low-temperature environment (Comparative Examples 4 and 5).

(9) The photoreceptor in which the charge generation material consists only of a crystal type oxotitanylphthalocyanine is optically decayed by weak exposure because of its high sensitivity, providing insufficient resolution under any environment, though it has stable sensitivity to environmental fluctuation (Comparative Example 6).

What is claimed is:

1. A photoreceptor comprising an undercoat layer between a conductive support and a photosensitive layer, wherein the undercoat layer contains at least titanium oxide microparticles coated with anhydrous silicon dioxide and a first binder resin, the photosensitive layer is a monolayered photosensitive layer containing at least a charge generation material and a charge transport material or a multilayered photosensitive layer formed of a charge generation layer containing a charge generation material and a charge transport layer containing a charge transport material stacked in this order or in an inverse order, and the charge generation material contains a crystal type oxotitanylphthalocyanine having peaks in an X-ray diffraction spectrum with Cu—Kα characteristic X-rays (0.15418 nm) at Bragg angles (2θ±0.2°) of 7.3°, 9.4°, 9.6°, 11.6°, 13.3°, 17.9°, 24.1° and 27.2°, in which a peak bundle formed by overlapping the peaks at 9.4° and 9.6° is a largest peak, and the peak at 27.2° is a second largest peak; and an X-type metal-free phthalocyanine having peaks in the X-ray diffraction spectrum at Bragg angles (2θ±0.2°) of 7.5°, 9.1°, 16.7°, 17.3° and 22.3°;

wherein the X-type metal-free phthalocyanine is contained in the photosensitive layer in a proportion of 10% by weight to 70% by weight with respect to the crystal type oxotitanylphthalocyanine; and wherein the titanium oxide microparticles have anhydrous silicon dioxide in a proportion of 10% by weight to 33% by weight.

2. The electrophotographic photoreceptor of claim 1, wherein the X-type metal-free phthalocyanine is contained in the photosensitive layer in a proportion of 40% by weight to 70% by weight with respect to the crystal type oxotitanylphthalocyanine.

3. The electrophotographic photoreceptor of claim 1, wherein the charge generation layer contains a second binder resin, and the ratio by weight between the charge generation material and the second binder resin is 10:90 to 99:1.

4. The electrophotographic photoreceptor of claim 1, wherein the first binder resin is polyamide resin.

5. The electrophotographic photoreceptor of claim 1, wherein the ratio by weight between the titanium oxide microparticles and the first binder resin is 10:90 to 95:5.

6. The electrophotographic photoreceptor of claim 1, wherein the titanium oxide microparticles have an average primary particle diameter of 20 nm to 100 nm.

7. The electrophotographic photoreceptor of claim 1, wherein the undercoat layer have a thickness of 0.05 μm to 5 μm.

8. The electrophotographic photoreceptor of claim 1, wherein the photosensitive layer is a multilayered photosensitive layer.

9. The electrophotographic photoreceptor of claim 1, wherein the photosensitive layer is a multilayered photosensitive layer in which the charge generation layer and the charge transport layer are stacked in this order.

10. An image forming apparatus comprising at least: the electrophotographic photoreceptor of claim 1; a charging means for charging the electrophotographic photoreceptor; an exposure means for exposing the charged electrophotographic photoreceptor to form an electrostatic latent image; a developing means for developing the electrostatic latent image formed by the exposure to form a toner image; a transfer means for transferring the toner image formed by the development onto a recording material; a fixing means for fixing the transferred toner image onto the recording material to form an image; and a cleaning means for removing and recovering a toner left on the electrophotographic photoreceptor, wherein the exposure means is an exposure device exposing a surface of the electrophotographic photoreceptor by using a semiconductor laser with a pixel density of 1200 dpi or more to form the electrostatic latent image.

* * * * *